US011970303B2

(12) United States Patent
Pinyayev

(10) Patent No.: US 11,970,303 B2
(45) Date of Patent: Apr. 30, 2024

(54) INFRARED-ASSISTED SHRINK WRAP PRODUCT BUNDLING

(71) Applicant: The Procter & Gamble Company, Cincinnati, OH (US)

(72) Inventor: Aleksey Mikhailovich Pinyayev, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 193 days.

(21) Appl. No.: 17/584,639

(22) Filed: Jan. 26, 2022

(65) Prior Publication Data

US 2023/0234739 A1 Jul. 27, 2023

(51) Int. Cl.
*B65B 53/06* (2006.01)

(52) U.S. Cl.
CPC ..... *B65B 53/063* (2013.01)

(58) Field of Classification Search
CPC ..... B65B 53/063; B65B 59/00
See application file for complete search history.

(56) References Cited

U.S. PATENT DOCUMENTS 3,357,153 A * 12/1967 Shaffer ..... B65B 53/063 53/442
3,591,767 A * 7/1971 Mudie ..... B65B 53/02 219/244
3,777,446 A 12/1973 Graver
3,778,964 A * 12/1973 Rowland ..... B65B 53/02 219/388
4,172,873 A 10/1979 Spicer
4,979,314 A * 12/1990 Fresnel ..... B65B 53/063 34/104

(Continued)

FOREIGN PATENT DOCUMENTS

| | | |
|---|---|---|
| EP | 0571262 A1 | 11/1993 |
| EP | 1288129 A2 | 3/2003 |
| EP | 2733076 A1 | 5/2014 |

OTHER PUBLICATIONS

PCT Search Report and Written Opinion for PCT/US2023/061062 dated Jun. 5, 2023, 13 pages.

*Primary Examiner* — Thomas M Wittenschlaeger
*Assistant Examiner* — Katie L Gerth
(74) *Attorney, Agent, or Firm* — Jay A. Krebs; Alexandra S. Anoff

(57) ABSTRACT

Systems and methods for shrink wrap bundling a group of heat-sensitive products are provided. A method comprises: providing a heating oven with a convective heat source and a radiant electromagnetic energy source therein and a product; and wrapping the product with a shrink film that comprises an activation temperature and an electromagnetic energy absorbance level. The method also comprises: placing the wrapped product inside the heating oven for a predetermined duration of residence time; exposing the wrapped product to radiant electromagnetic energy for a predetermined duration of exposure time, wherein the direction of the electromagnetic energy is coincidental or approximately coincidental with a plane of the shrink film; and removing the wrapped product from the heating oven resulting in the wrapped product being robustly bundled according to a defined Bundle Rigidity Test without substantial damage to the heat-sensitive products of the wrapped product.

18 Claims, 19 Drawing Sheets

(56) References Cited

U.S. PATENT DOCUMENTS

| | | | | |
|---|---|---|---|---|
| 5,403,635 | A * | 4/1995 | Hoffman | B29C 66/73715 428/347 |
| 8,196,376 | B2 | 6/2012 | Uetsuki et al. | |
| 8,235,712 | B1 * | 8/2012 | Lewis | B65D 23/0878 432/143 |
| 8,367,978 | B2 * | 2/2013 | Williams | F26B 3/283 219/400 |
| 9,080,027 | B2 | 7/2015 | Haruta et al. | |
| 9,352,508 | B2 | 5/2016 | Haruta et al. | |
| 10,392,485 | B2 | 8/2019 | Ishimaru et al. | |
| 11,401,071 | B2 * | 8/2022 | Van Heck | B65C 9/02 |
| 2005/0193690 | A1 * | 9/2005 | Schoeneck | B29C 66/4312 219/121.6 |
| 2010/0032077 | A1 * | 2/2010 | Uetsuki | B65B 53/063 156/497 |
| 2011/0088354 | A1 | 4/2011 | Murgia et al. | |
| 2011/0165316 | A1 * | 7/2011 | Baccini | H01L 21/67721 118/712 |
| 2014/0041341 | A1 * | 2/2014 | Koolhaas | B65B 53/02 53/442 |
| 2015/0183539 | A1 * | 7/2015 | Cox | B65B 51/10 53/558 |
| 2020/0115085 | A1 * | 4/2020 | Beesley | B65B 53/063 |
| 2021/0292023 | A1 * | 9/2021 | Uetsuki | B65B 53/063 |

* cited by examiner

INFRARED-ASSISTED SHRINK WRAP PRODUCT BUNDLING

FIELD

The present invention relates generally to the field of product packaging, and more particularly to shrink wrapping systems and methods for heat sensitive products that employ localized infrared radiation (IR) outside heat-sensitive areas of the product in association with maximizing IR absorbance by shrink films with defined IR absorbance levels.

BACKGROUND

A known method of product bundling includes wrapping a group of products (e.g., thermoplastic bottles) with a shrink film and passing the wrapped packages through a hot air oven such that the air temperature exceeds the film activation temperature. This allows the film to stretch tight around the products, creating a robust bundle which keeps the products secured during handling and transportation. A disadvantage of this method is that if the products are heat sensitive (e.g., thermoplastic bottles with thin walls, products that are made from a material with a low melting point, and/or packaging with delicate labels and/or decorative) they can be damaged by the high heat required to shrink the shrink film. Although this problem could be minimized by using a shrink film with a lower activation temperature, attempts to develop such a film have been unsuccessful.

Another known method for shrink bundling products involves application of infrared radiation (IR) to the product with a shrink sleeve loosely placed around the product such that the IR gets absorbed by the film, converted into heat and shrinks the sleeves around the product, creating shrink labels. However, these methods lead to the same drawbacks as the traditional hot air technology when applied to heat-sensitive products because of the high intensity of the IR required to shrink the bundling film.

Finally, a combination of a hot air heating with IR is used for some industrial processes for the purpose of curing and drying where each of these methods alone is not sufficient to deliver the required result for heat-sensitive products. However, these processes are imprecise and can damage heat-sensitive products.

Thus, there is need for improved bundling techniques for heat-sensitive products that create robust bundles with existing shrink films, while also minimizing or eliminating bottle deformation caused by existing shrink-wrapping machines and processes.

SUMMARY

The present invention can solve one or more drawbacks noted in the Background section. In one embodiment, a method for shrink wrap bundling a group of heat-sensitive products is provided. The method for bundling a group of products comprises: providing a heating oven with a convective heat source and a radiant electromagnetic energy source therein and a group of heat-sensitive products, wherein the group of heat-sensitive products comprises a front side, a back side, a top, a base, a right side, and a left side, and wherein each heat-sensitive product of the group of heat-sensitive products comprises a wall with a thickness made from a material with a softening temperature; and wrapping the group of heat-sensitive products with a shrink film that comprises an activation temperature and an electromagnetic energy absorbance level and covers the front side, the back side, the top, the right side and the left side, and the base forming a wrapped group of heat-sensitive products, wherein the group of heat-sensitive products are wrapped by the shrink film. The method also comprises placing the wrapped group of heat-sensitive products inside the heating oven for a predetermined duration of residence time; exposing the wrapped group of heat-sensitive products to radiant electromagnetic energy for a predetermined duration of exposure time, wherein the direction of the electromagnetic energy is coincidental or approximately coincidental with a plane of the shrink film; and removing the wrapped group of heat-sensitive products from the heating oven resulting in the wrapped group of heat-sensitive products being robustly bundled according to a defined Bundle Rigidity Test without substantial damage to the heat-sensitive products of the wrapped group of heat-sensitive products.

In another embodiment, a system for shrink wrap bundling a heat-sensitive product is provided. The system comprises a heating oven adapted to receive a product loosely wrapped with a shrink film and shrink wrap the shrink film around the product. The system further comprises one or more heating elements that provide convective heat inside the heating oven and a REE source that provides REE inside the heating oven, wherein the REE source directs the REE to a heat-resistant region of the product as opposed to the heat-sensitive area of the product when the product is located inside the heating oven.

DETAILED DESCRIPTION

Figure 1:
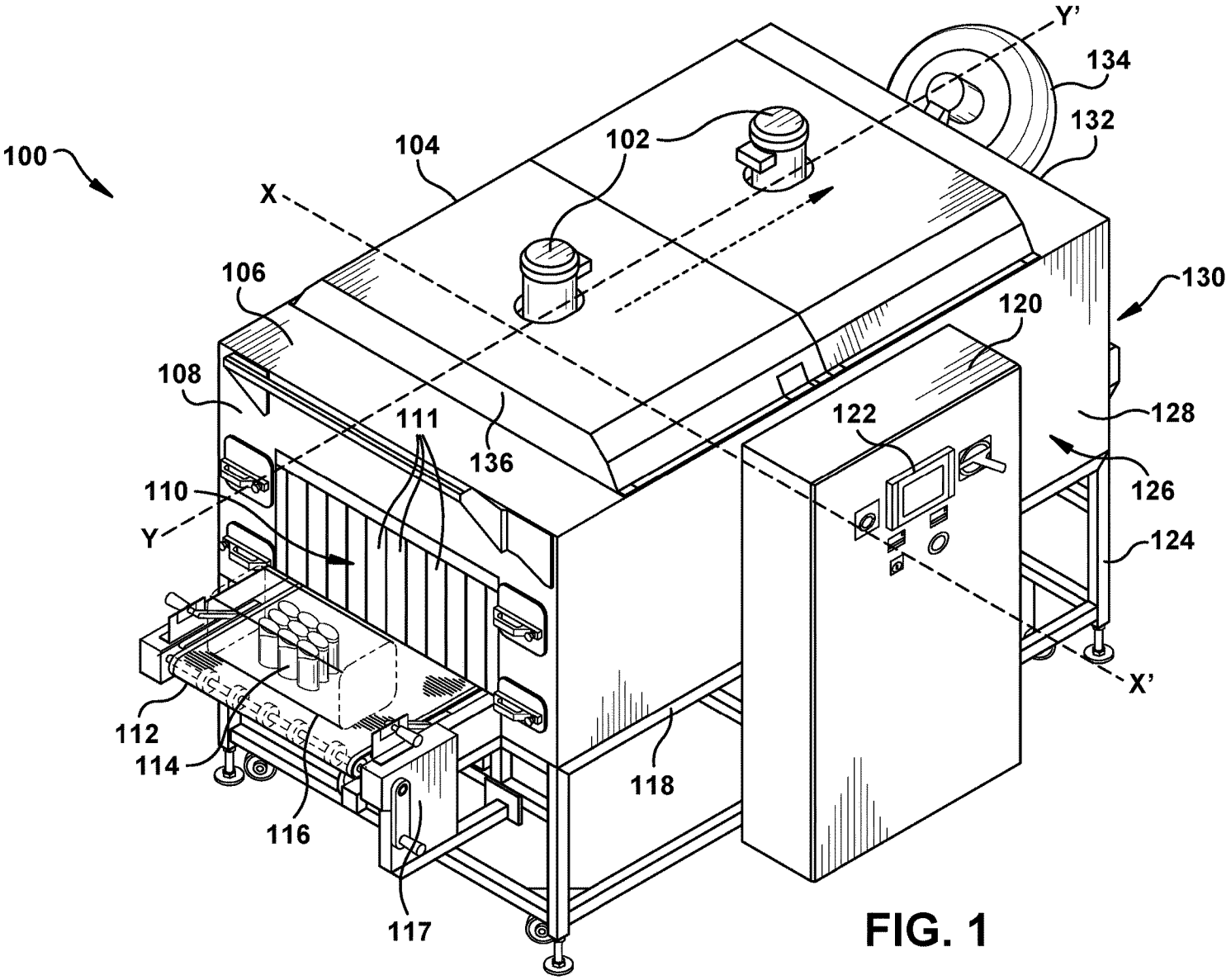
FIG. 1 illustrates an example shrink tunnel system for shrink wrap bundling a group of heat-sensitive products (e.g., bottles) in accordance with one or more embodiments.

The following detailed description is merely illustrative and is not intended to limit embodiments, application and/or uses of embodiments. Furthermore, there is no intention to be bound by any expressed and/or implied information presented in the preceding Background and/or Summary sections, and/or in this Detailed Description section.

To reduce the amount of polymeric material used in packaging, it can be advantageous to make a plastic package with thinner walls, shoulders and corners, rounded shoulders and corners, and/or a shorter and thinner neck (hereafter "lightweight product" or "lightweight bottle"). The lightweight product can be made without pointed or distinct edges or corners. It can be beneficial to bundle these bottles together with shrink wrap for ease and to prevent damage to the products during shipping and transportation.

It can be difficult to bundle lightweight products with traditional shrink wrap in an oven without damaging the products. Shrink films are typically formed with a polymeric material that has been stretched into an extended or oriented polymer film in which the molecular chains are extended or elongated. The shrink film can be made from a plastic polymer material (e.g., polyolefin, polyvinyl chloride, polyethylene, and/or polypropylene), that can be optically transparent or semi-transparent. Application of energy/heat, such as radiant electromagnetic energy (REE), to the shrink film increases the molecular motion of the polymer chains in the film, causing the elongated polymers to recoil or shrink, back to their preferred random and disordered conformation, resulting in the shrink film tightly conforming around the surfaces of the product about which it is wrapped.

However, it was found that using a CERMEX oven used in the typical way to create a shrink wrap bundle lightweight bottles, damaged these bottles. Many bottles that were tested had dimpling and other distortions at the shoulders and bottom corners of the bottle. This damage is not only unsightly, but also compromises the physical integrity of the bottle.

It was found that the deformations were caused by softening the polyethylene terephthalate (PET) material of the lightweight packages in the areas where the heat concentrated (e.g., the shoulders and bottom corners). First, the inventors tried to prevent the damage by reducing the temperature setting of the oven. However, this reduced the bundle integrity, and it was not possible to find an optimum setting where both the lightweight package shape and bundle integrity were maintained at the same time.

It was found that infrared radiation (IR) provided localized heat from the front, back and sides of the bundle, a proper bundling could be achieved at a lower oven temperature setting. Most of IR was applied outside of the zones where package damage was normally seen. This way, the shrink film was able to get to its operating temperature without overheating the sensitive areas of the package, resulting in a robust bundle and undamaged polymeric packaging.

The disclosed subject matter incorporates IR into the bundling process in a manner that is tailored to minimize or prevent damage to the product while also providing for robust bundling according to the Bundle Rigidity Test (disclosed herein). A shrink tunnel system can be provided that incorporates one or more IR panels within the heating oven and/or outside of the heating oven (e.g., at the tunnel entry and/or exit). The manner in which the IR is applied, including (1) the angle/direction of application, (2) duration of application, and (3) intensity of application, is tailored to minimize or prevent damage to heat-sensitive areas of the product, which can be regions of the product that are prone to deformation from excessive heat (e.g., the shoulders and/or bottom corners of the bottle) or able to generate undesirable side effects (such as water vapor from the side walls of the packaging cartons). In some implementations, the IR panels may be positioned relative to the product and the shrink film such that the IR heat is localized outside of the heat-sensitive areas of the product. Additionally, or alternatively, IR energy can be applied in a direction parallel to the planar surfaces of the film, thereby maximizing the amount of IR energy absorbed by the film relative to the amount absorbed by the product. Further, the film can have a known IR absorbance level that exceeds a predetermined value, so that a significant portion of IR energy was absorbed by the film before it reaches the product. The combination of these elements provides for localizing the heat to keep it away from the heat-sensitive areas of the product and maximizes the absorption of the IR energy by the film, thereby minimizing the leftover energy applied to the product and the potential for the damaging the product.

Other suitable ways of focusing the IR energy toward the heat-resistant region and away from the heat-sensitive area of the product include, but are not limited to: tailoring the IR panel dimensions based on the relative dimensions and positions of the heat-resistant and heat-sensitive areas of the product (e.g., making the height of the panel less than the distance between the sensitive areas at the top and bottom of the bottle), using IR panels with a concave shaped surface, using IR mirrors around the panels to direct the IR energy toward the heat-resistant region and away from the heat-sensitive area, using IR lenses between the panel and the product to direct the IR energy toward the heat-resistant region and away from the heat-sensitive area, and using several smaller panels localized against the heat-resistant areas of the product as opposed to a single larger panel. The amount (e.g., intensity and/or duration) of IR energy applied can also be tailored based on the product type (e.g., a group of plastic bottles, a cardboard box, etc.), the material of the product, the softening temperature of the product, the activation temperature of the shrink film, the contents of the product, the design of the product, the dimensions of the product, and the IR absorbance level of the shrink film.

The IR panels can be incorporated into a shrink tunnel system that also uses convective heat (e.g., hot air) heating elements to facilitate shrinking the film around the product in combination with the IR heat. The amount (e.g., temperature/intensity and/or duration) of convective heat applied can be reduced relative to shrink wrapping systems that do not incorporate IR heat. In this regard, the combination of the IR heat with the reduced convective heat temperature provides for significantly reducing damage and deformation to heat-sensitive areas of a product while further providing for robustly bundling the product according to a defined Bundle Rigidity Test (described herein). The disclosed techniques can thus be used to robustly bundle heat-sensitive products with standard, commercially available low-cost shrink films without substantial damage to the product. An energy source different from IR can be utilized, such as radio frequency (RF), microwaves (MW), visible light or ultraviolet (UV). In this regard, the disclosed systems and methods can incorporate other forms of radiant electromagnetic energy (REE) to facilitate shrink wrapping heat-sensitive products. The term REE as used herein refers to any form or radiant electromagnetic energy, including IR, RF, MW, UV and other forms.

The disclosed techniques can be used for bundling a variety of products. In various exemplary, the disclosed techniques are described in association with bundling groups (e.g., including at least one, alternatively two or more, alternatively three or more, alternatively four or more, alternatively five or more, alternatively six or more, alternatively eight or more) of heat-sensitive products formed with a polymeric (i.e., plastic) material. For example, the products may include bottles for cosmetic and personal care compositions (e.g., soap including liquid hand soap, body wash, hair care products including shampoo, conditioner, and/or styling products, and/or lotion, serum, and other skin care products), laundry detergent, dish soap, mouthwash and other oral care products, household and surface cleaners, insect repellants, water, and the like. However, the disclosed techniques are not limited to bundling polymeric bottles and can be applied to shrink wrap bundle other types of products. The disclosed techniques can also be used for in association with bundling products sold in tubes (e.g., toothpaste, hair care products such as conditioner and styling products, lotion) that include polymeric tubes, metal tubes, and laminates that include a combination of different materials. The disclosed techniques can be used for bundling of the heat-sensitive packaging cartons made from other materials (e.g., pulp, paper, cardboard or other moisture-absorbing materials, aluminum or other metals, and/or bamboo). With these implementations, the use of IR without hot air and/or reduced hot air minimizes the amount of moisture released by the carton during the shrink-wrapping process that can condense on the outside of the product placed into the carton and damage the product. Still, another application of the proposed invention is for the packaging of the articles, in particular articles with polymeric portions, such as toothbrushes, hairbrushes, etc. The disclosed technique can also be used for securing a shrink sleeve label to one or more packages.

One or more embodiments are now described with reference to the drawings, wherein like referenced numerals are used to refer to like elements throughout. Repetitive description of like elements illustrated throughout the figures is omitted for sake of brevity. In the following description, for purposes of explanation, numerous specific details are set forth in order to provide a more thorough understanding of the one or more embodiments. It is evident, however, in various cases, that the one or more embodiments can be practiced without these specific details.

Figure 2:
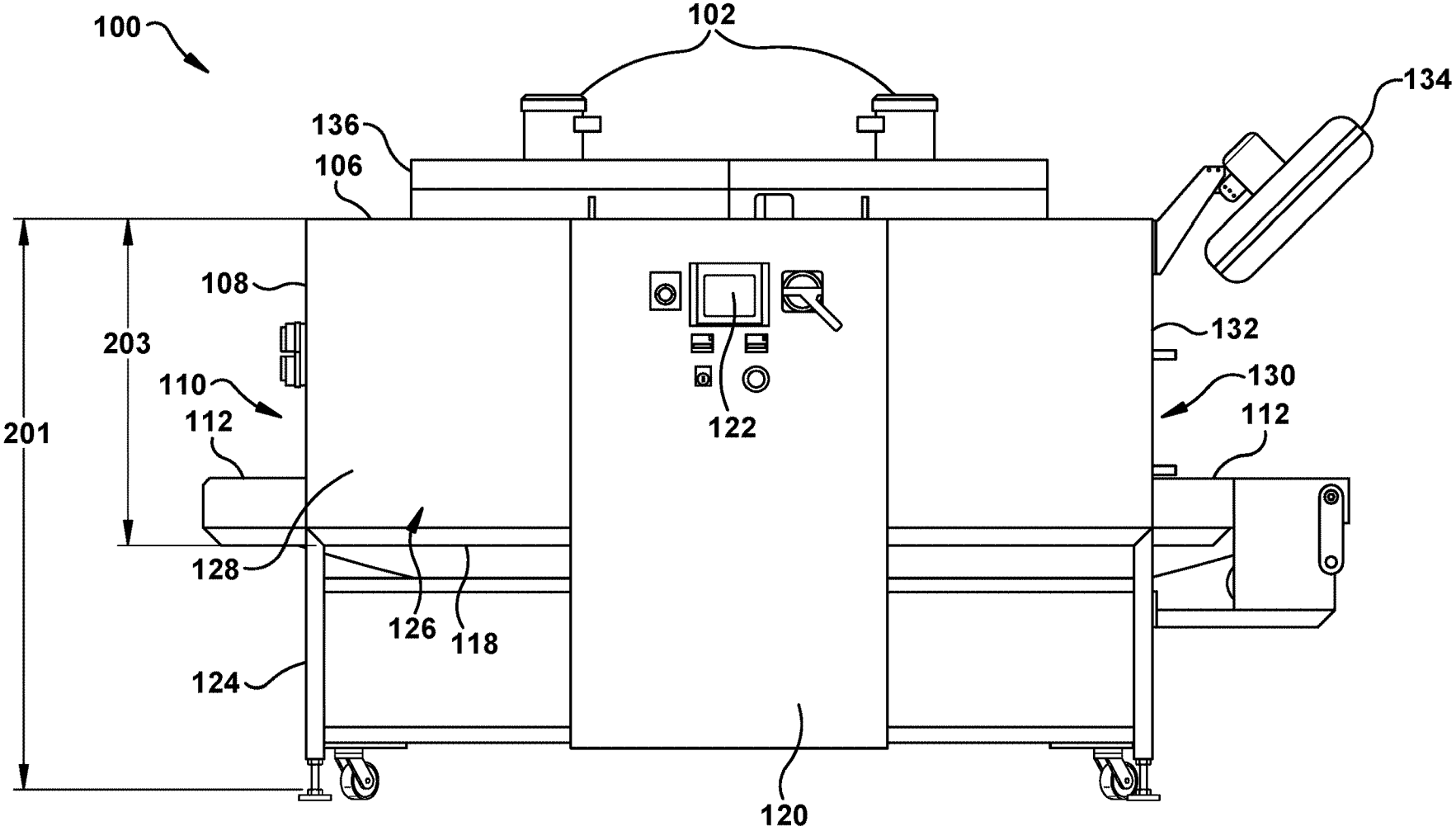
FIG. 2 is a side planar view of the example shrink tunnel system.
Figure 3:
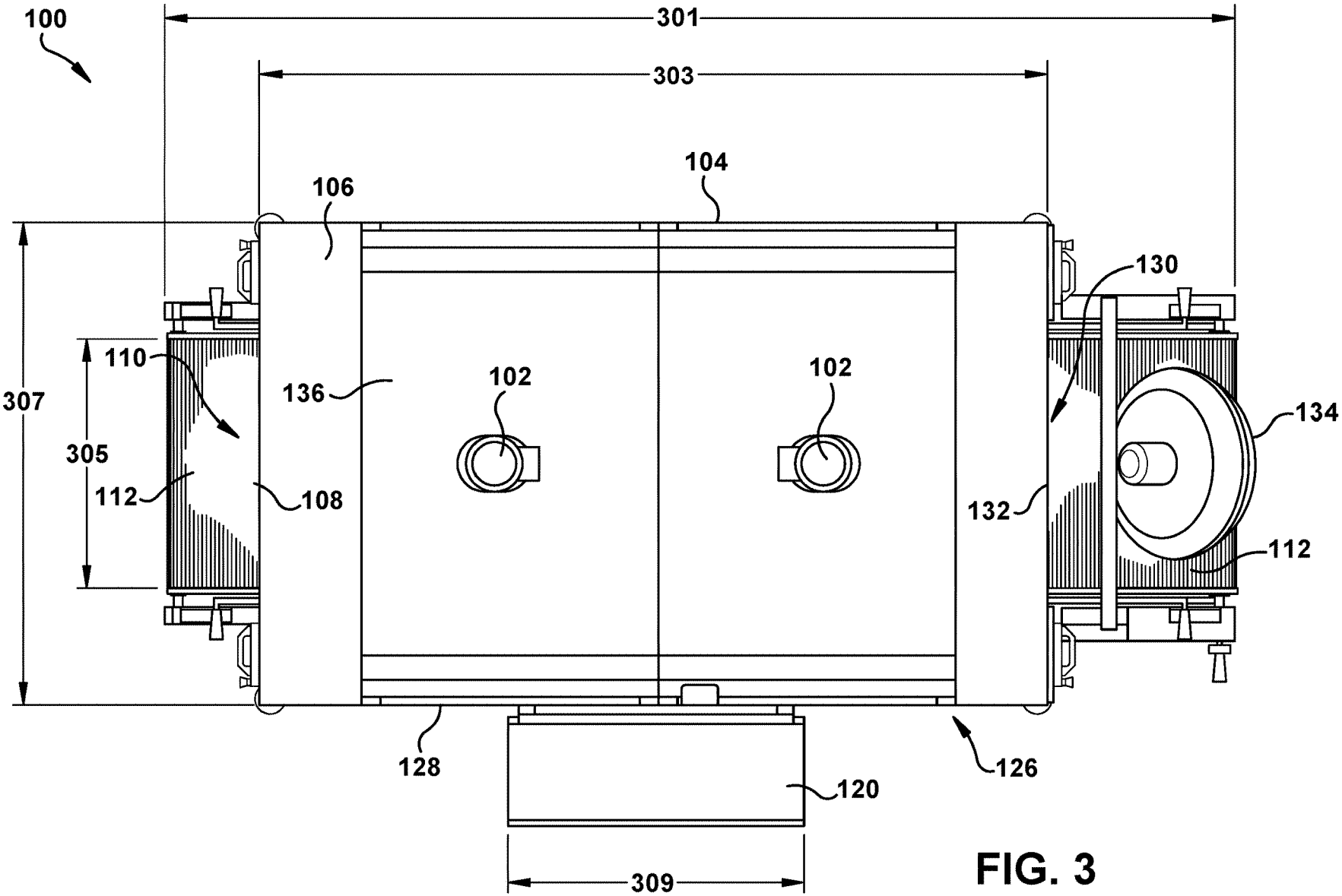
FIG. 3 is a top-down planar view of the example shrink tunnel system.

FIG. 1 illustrates an example shrink tunnel system 100 for shrink wrap bundling a heat-sensitive product. FIG. 2 is a top-down planar view of the example shrink tunnel system 100, and FIG. 3 is a side planar view of the example shrink tunnel system 100. With reference to FIGS. 1-3, the shrink tunnel system 100 includes a heating oven 126 adapted to receive a product 114 loosely wrapped with a shrink film 116 and shrink wrap the shrink film around the product. FIG. 1 shows the product includes a group of heat-sensitive bottles. The heating oven 126 corresponds to a tunnel defined by a ceiling 106, a base 118 (or floor) opposite the ceiling 106, opposing sidewalls 128 and 104, an infeed opening 110 located on the front side 108 of the heating oven 126, and an exit opening 130 located on backside 132 of the heating oven 126. The shrink tunnel system 100 further includes a conveyor belt 112 positioned over and adjacent to the base 118 that feeds the product 114 into the heating oven 126 in a machine direction (e.g., along axis Y-Y' from Y to Y') through the infeed opening 110 and out of the heating oven 126 through the exit opening 130. The conveyor belt 112 can include or be operatively coupled to a conveyor drive assembly 117 that includes the electromechanical components that drive the operations of the conveyor belt (e.g., one or more motors, power elements, etc.). As illustrated in FIG. 1, the infeed opening 110 can be covered by flaps 111 formed with a soft material (e.g., rubber, fabric, etc.) that allows the product 114 loosely wrapped with the shrink film 116 to pass therethrough without damaging or deforming the product 114 or the shrink film 116. The flaps 111 can provide for retaining and maintaining the REE and/or convective heat inside the heating oven 126. Although not shown, the exit opening 130 can also include flaps 111 and correspond to the infeed opening 110. Alternatively, the flaps 111 can be removed from the infeed opening 110 and/or the exit opening 130. The backside 132 of the heating oven 126 includes a fan 134 positioned over the exit opening 130 that provides for cooling the shrink-wrapped product after exiting through the exit opening 130. Alternatively, the fan may be removed and/or replaced with an alternative cooling means. The shrink tunnel system 100 further include a base frame 124 upon which the heating oven 126, the conveyor belt 112 and the conveyor drive assembly 117 is mounted.

During operation, the loosely wrapped product is conveyed inside the heating oven 126 through the infeed opening 110 via the conveyor belt 112 in the machine direction (e.g., along axis Y-Y'). Once inside, the shrink tunnel system 100 can employ REE (e.g., IR or another form) or a combination of REE and convective heat to shrink wrap the shrink film 116 around the product 114, causing the shrink film 116 to shrink and tighten around the product 114, thereby forming a bound or bundled product. The bundled product is then conveyed outside the heating oven 126 through the exit opening 130 and removed. As described in greater detail below, the manner in which the REE is applied to the product 114 and the shrink film 116, including the particular areas of the product 114 to which the REE is localized, the angle/direction of application of the REE to the product 114 and the shrink film 116 and the duration and intensity of application, is tailored to minimize or prevent damage to heat-sensitive areas of the product 114 while also robustly bundling the product 114 according to the Bundle Rigidity Test (described herein). The amount (e.g., intensity and/or duration) of REE applied can also be tailored based on the known REE absorbance level of the shrink film 116, the material of the product, the softening temperature of the product, the activation temperature of the shrink film, the contents of the product, the design of the product, and the dimensions of the product. In some examples, the shrink film can include infrared absorbers. Further, in embodiments in which shrink tunnel system 100 also use both REE and convective heat, the amount (e.g., temperature/intensity and/or duration) of convective heat applied can be tailored to account for the usage of both convective heat and REE heat. In particular, the amount of convective heat applied can be reduced relative to shrink wrapping systems that do not incorporate REE heat, thereby minimizing damage and deformation to heat-sensitive areas of a product while further providing for robustly bundling the product according to the Bundle Rigidity Test (described herein).

To facilitate this end, the heating oven 126 can include a convective heating system that provides a main source of convective heat inside the heating oven 126 and/or an REE source that applies REE within the heating oven 126. The REE source include or correspond to an electromechanical machine or device that generates and emits one or more forms of REE. For example, the REE includes IR and the REE source can include or correspond to one or more IR panels. Additionally, or alternatively, the REE can include (but is not limited to) RF, MW, or visible light or UV light. In FIGS. 1-3, the REE source is located inside the heating oven 126 and thus hidden from view. Additional details regarding the REE source and the manner in which the REE source is tailored localize application of the REE outside the heat-sensitive areas of the product 114 are described infra.

The convective heating system can include one or more heating elements that provide convective heat inside the heating oven 126, one or more fan assemblies that circulate the heated air inside the heating oven 126 and adjustable dampers that direct the heated air to specific areas of the heating oven 126. The heating elements, fan assemblies and dampers are located inside the heating oven 126 and are thus hidden from view in FIGS. 1-3. For example, in some implementations, the heating elements and the fan assemblies can be located at the top of the heating oven 126 inside/under a hood portion 136 of the ceiling 106. FIGS. 1-3 show the shrink tunnel system 100 can include two fan assemblies respectively driven by fan motors located within a ventilation area 102. The fans draw the air across the heating elements and direct the heated air down the sides of the tunnel through ducts to discharge the air into the heating oven 126. The adjustable dampers direct the air to specific areas of the heating oven.

The shrink tunnel system 100 further includes a control unit 120 that includes hardware and/or software components that provide for controlling one or more of the electromechanical operations of the shrink tunnel system 100. For example, the control unit 120 can include one or more machine controls and machine control devices of the shrink tunnel system 100 (e.g., relays, IR panel controller, heating system controller, temperature controller, conveyor belt controller, motor controllers, main power switch, main disconnect switch, etc.). The control unit 120 can be communicatively and/or operatively coupled to the various electromechanical components of the shrink tunnel system 100, including but not limited to, the heating system, the REE source (e.g., IR panels or the like), the conveyor drive assembly 117, a cooling system (e.g., the fan 134 and other cooling elements), vents, temperature controls, sensors, and the like. The machine interface used for control unit 120 can vary. In the embodiment shown, the control unit 120 includes a display 122 and some electromechanical knobs and buttons that can correspond to one or more machine controls for controlling one or more electromechanical operations of the shrink tunnel system 100. In some implementations, the display 122 can include a touchscreen display that presents graphical controls via a graphical user interface rendered on the display 122. The control unit 120 can include or be operatively coupled to at least one memory that stores computer executable instructions and at least one processor that executes the computer executable instructions stored in the memory, as discussed herein with reference to FIG. 15. With these embodiments, one or more electromechanical operations of the shrink tunnel system 100 can be controlled via one or more computer executable instructions or components.

The dimensions of the shrink tunnel system 100 can vary. In one embodiment, the dimensions of the entire system are about 200 centimeters (cm) wide, 350 cm long, and 200 cm high, and the dimensions of the heating oven 126 are about 100 cm wide, 250 cm long, and 40 cm high. For example, with reference to FIG. 2, the height 201 of the shrink tunnel system 100 from the ground to the ceiling 106 may be about 150 cm and the height 203 of the heating oven 126 from the base 118 to the ceiling 106 may be about 40 cm. With reference to FIG. 3, the width 307 of the heating oven 126 (e.g., between the opposing sidewalls 104 and 128) may be about 100 cm and the width of the conveyor belt 112 may be about 80 cm. The width of the control unit 120 may be about 100 cm. The length 301 of the conveyor belt 112 may be about 330 cm and the length 303 of the heating oven 126 may be about 255 cm. It should be appreciated that the above noted dimensions are provided to give a general frame of reference of the size of the shrink tunnel system in accordance with one or more embodiments, and that the dimensions can be adapted for various configurations.

Figure 4A:
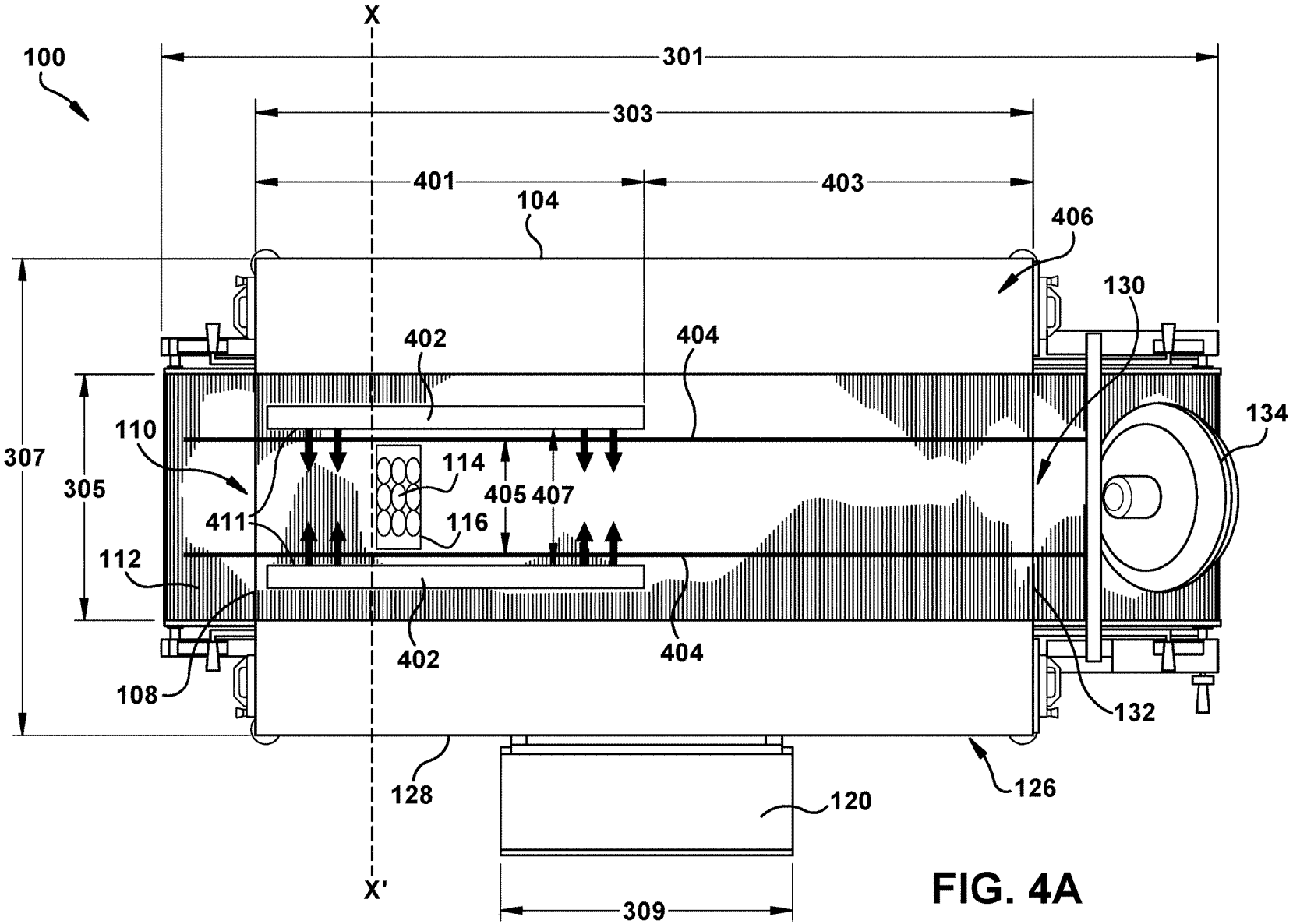
FIGS. 4A-4D present top-down planar views of the example shrink tunnel system with the ceiling removed in accordance with various embodiments.
Figure 4B:
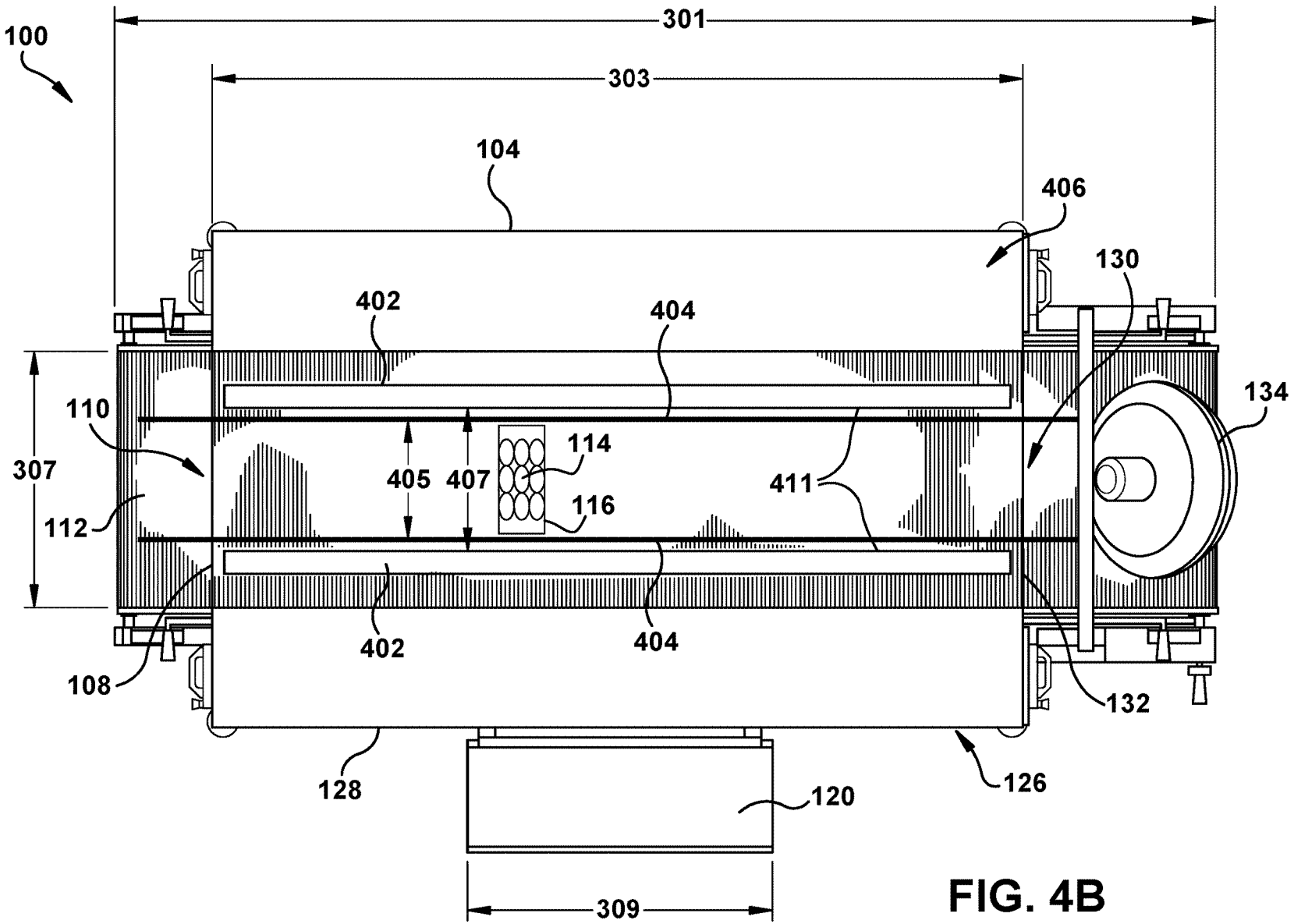
Figure 4C:
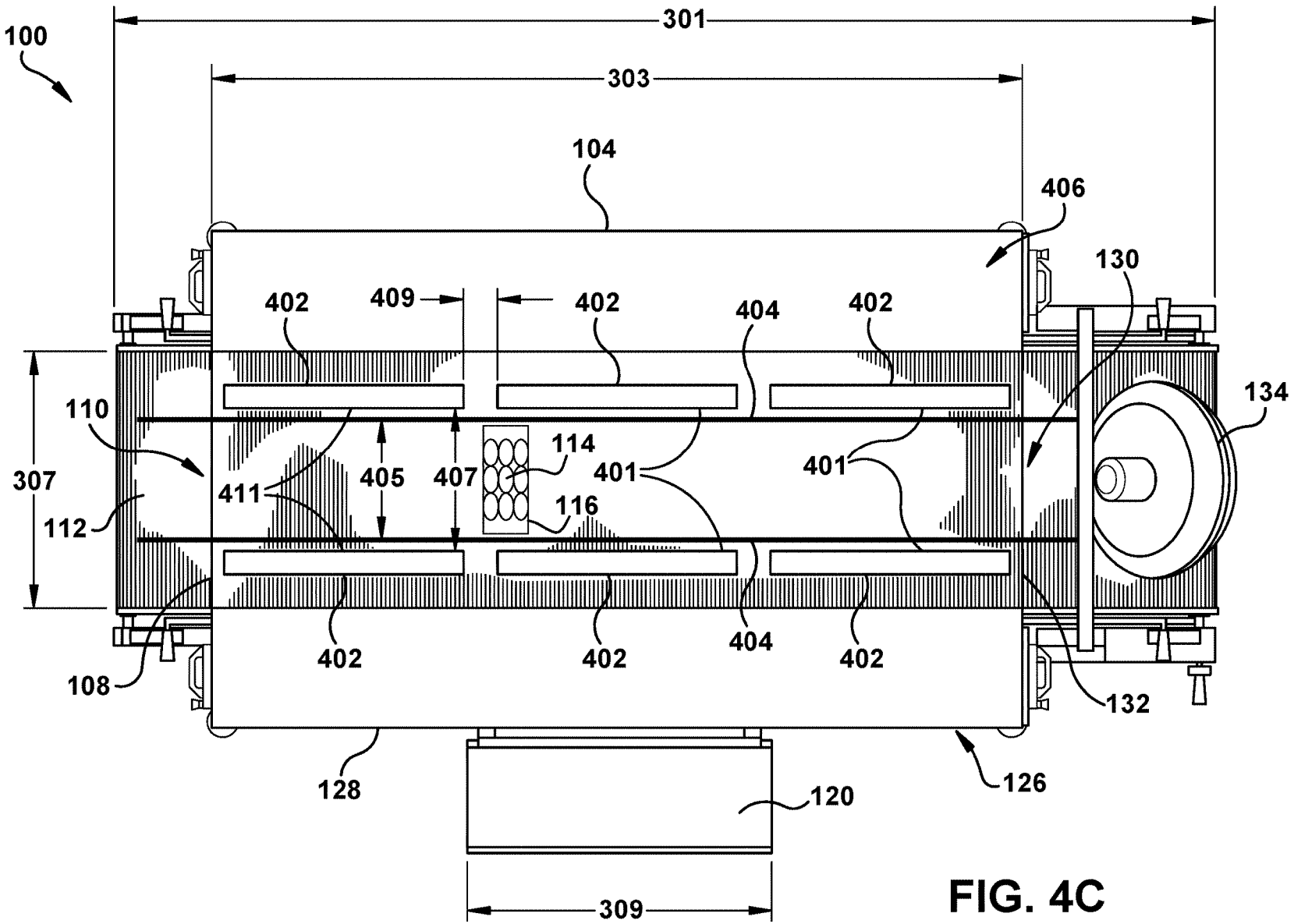

FIGS. 4A-4D present top-down planar views of shrink tunnel system 100 (and variations thereof) with the ceiling 106 and hood portion 136 removed in accordance with different embodiments. As illustrated in FIGS. 4A-4C, the inside 406 of the heating oven 126 can include one or more REE elements 402 positioned over the conveyor belt 112 that serve as the REE source. The one or more REE elements 402 can be mounted a slight distance over (e.g., hovering over) the conveyor belt 112 such that the conveyor belt runs under the elements without contact. The shrink tunnel system 100 can include opposing guiderails 404 positioned over the conveyor belt 112 between the opposing REE elements 402 that facilitate guiding the loosely wrapped product into the desired position/alignment on the conveyor belt 112 within the heating oven 126 and maintaining the desired position/alignment. The opposing guiderails 404 can also prevent the shrink film 116 as loosely wrapped around the product 114 from contacting the surfaces of the opposing REE elements 402. The opposing guiderails 404 can also be mounted a slight distance over (e.g., hovering over) the conveyor belt 112 such that the conveyor belt runs under the opposing guiderails 404 without contact.

The one or more REE elements 402 can include or correspond to an electromechanical machine or device that generates and emits one or more forms of REE. The REE can include IR and the one or more REE elements 402 can include or correspond to one or more IR panels. Additionally, or alternatively, the one or more REE elements 402 can correspond to electromechanical panels that emit RF, MW, or visible light or UV light. In either of these embodiments, the REE elements 402 (e.g., panels) can be positioned on opposite sides of the conveyor belt 112 with respective emission surfaces 411 facing toward one another such that the emit REE toward one another (e.g., toward the centerline of the conveyor belt 112) in the direction indicated by the dashed arrow lines in FIG. 4A. The REE elements 402 illustrated in FIGS. 4A-4D can thus be considered opposing REE elements. In this regard, the angle/direction of emission of opposing REE elements 402 can be parallel or substantially parallel to the surface of the conveyor belt 112 and perpendicular to axis Y-Y'. With this configuration, when the loosely wrapped product is conveyed into the heating oven 126 and positioned between the REE elements 402, the direction of the emitted REE can be parallel or substantially parallel (e.g., between about 0° and about 30°) to the planer surfaces of the shrink film 116 as loosely wrapped around the product 114, as illustrated in FIG. 5A.

Figure 5B:
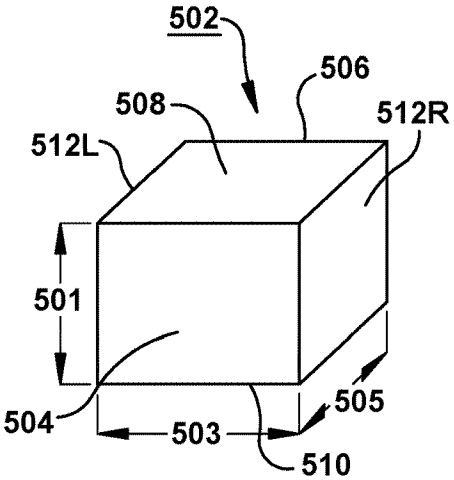
FIGS. 5A-5B presents an enlarged view of the inside of the heating oven from the entry-view perspective and the product in accordance with an embodiment.
Figure 5A:
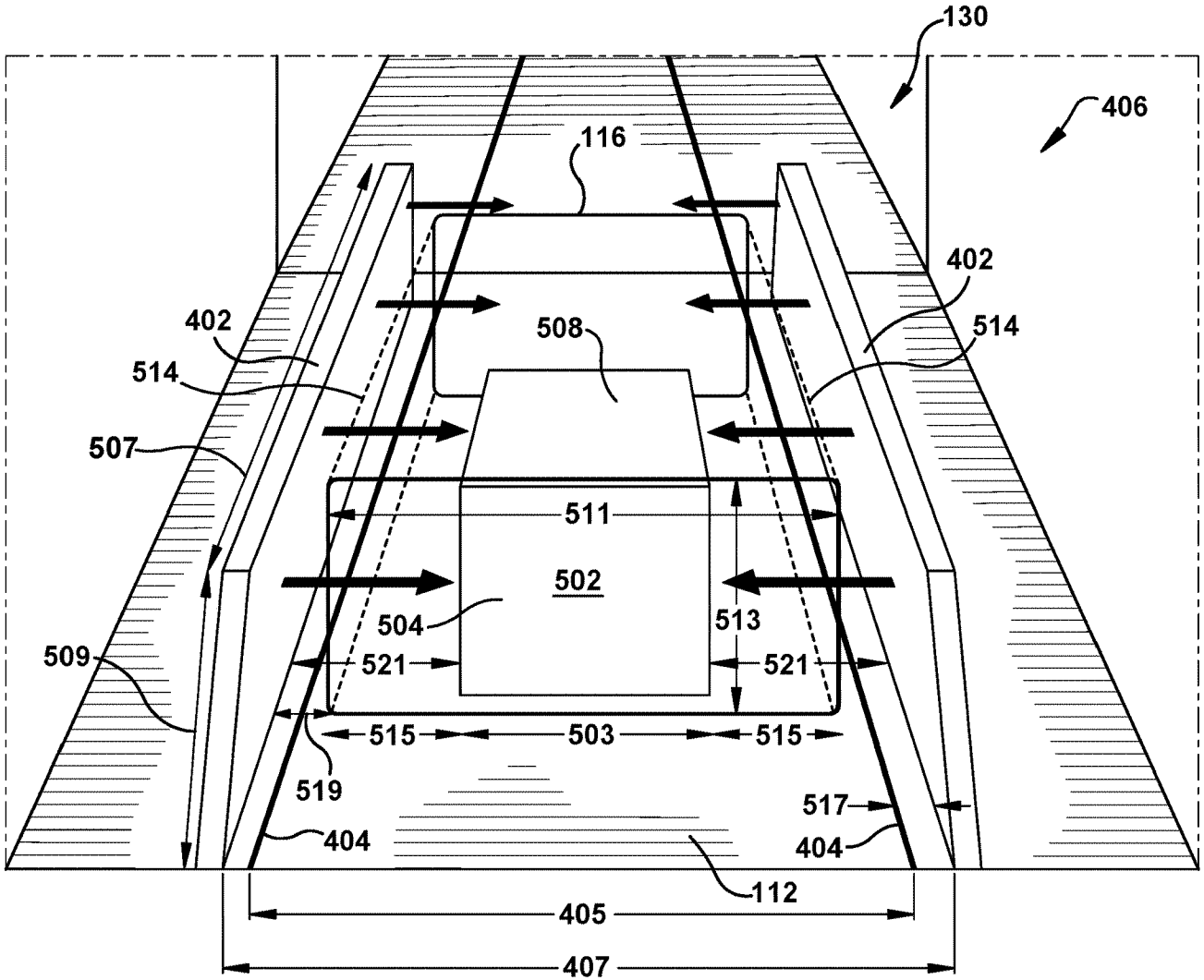

In particular, FIG. 5A presents an enlarged cross-sectional view (taken along axis X-X') of the inside 406 of the heating oven 126 from the entry-view perspective with a loosely wrapped product wrapped with the shrink film 116 and positioned therein relative to the opposing REE elements 402. In this example, the product 502 is illustrated as a plain box, however it should be appreciated that the product 502 can correspond to a group of heat-sensitive products, or another type of product. As illustrated in FIG. 4B, regardless of the type of the product 502, the product can generally be defined by a front side 504, a back side 506 opposite the front side, a top 508, a base 510 opposite the top, a right side 512R and a left side 512L. The dimensions of the product can be defined by a height 501, a width 502' and a length 505. The specific dimensions of the product can vary and the relative dimensions and position of the REE elements 402 can be tailored based on the dimensions of the product to localize the REE outside heat-sensitive areas of the product 502, as discussed below. As illustrated in FIG. 5A, the product 502 can be positioned on the conveyor belt 512 on its base 510 (e.g., with the base 510 contacting the surface of the conveyor belt 512) with its back side 506 oriented relative to the exit opening 130 and the front side oriented relative to the entry opening. The shrink film 116 can be wrapped around the product 502 so as to cover the front side 504, the top 508, the back side 506 and the base 510 with the left side 512L and the right side 512R left open or exposed. In this regard, the shrink film 116 as loosely wrapped around the product 502 can include front, back, top and bottom surfaces respectively corresponding to the front side 504, back side 506, top 508 and base 510 of the product 502. The respective surfaces of the shrink film 116 as loosely placed around the product 502 are thus parallel or substantially parallel with the corresponding surfaces of the product 502. The shrink film 116 further includes openings 514 (indicated by the dashed lines) on the respective right and left sides of the product that face the opposing REE elements 402 when the loosely wrapped product is positioned therebetween. As indicated by the dashed arrows, the direction of the REE emitted by the opposing REE elements 402 is parallel to the planar surface of the conveyor belt 112. The direction of emission is also parallel or substantially parallel with the respective top, back, front and bottom surfaces of the shrink film 116, which maximized absorption by the film while minimizing the amount of radiation applied to the product 502.

As illustrated in FIG. 5A, the product 502 as loosely wrapped with the shrink film 116 can be positioned on midline of the conveyor belt 112 an equal or substantially equal distance 521 between the emission surfaces 411 of the opposing REE elements 402. The amount of the defined distance 521 can be tailored based on the dimensions of the product 502 to minimize the amount of REE applied to left and right sides of the product 502 while maximizing absorption by the shrink film 116. The width 511 of the shrink film 116 as loosely wrapped around the product 502 extends a defined distance 515 on opposite sides of the product 502. The amount of the defined distance 515 can be tailored based on the dimensions of the product 502 and the amount of shrink film needed to at least partially cover the right and left sides of the product 502 when the shrink film 116 shrink wraps around the right and the left sides of the product in response to absorbance of the REE and/or convective heat within the heating oven 126. The amount of the defined distance 515 can also be tailored based on the known REE absorbance level of the shrink film. The width 511 of the shrink film 116 can be slightly less (e.g., between about 1.0 millimeter (mm) and about 100 mm) than the distance 405 between the opposing guiderails 404. The opposing guiderails 404 can be offset a slight distance 517 from the emission surfaces 411 of the opposing REE elements so as to prevent the side edges of the shrink film 116 from contacting the emission surfaces 411. In this regard, the distance 519 between the side edges of the shrink film 116 and the emission surfaces 411 of the REE elements 402 can be the same or slightly less than the distance 517 between the opposing guiderails 404 and the emission surfaces 411 of the opposing REE elements 402. The height 513 of the shrink film 116 as loosely wrapped around the product 502 can be the same or substantially the same as the height 501 of the product. The length 507, height 509 and position of the opposing REE elements 402 can further be tailored to direct the REE emitted by the opposing REE elements 402 toward a heat-resistant region of the product 502 and away from the heat-sensitive area. For example, the height 509 of the opposing REE elements 402 can be less than, greater than, or equal to the height 513 of the shrink film 116 and/or the height 501 of the product 502 depending the location of the heat-sensitive and heat-resistant regions on the product, the type of the product, the material of the product, the contents of the product, and so on. The distance 407 between the opposing REE elements 402 can also be tailored based on the dimensions of the product and the dimensions of the shrink film 116 as loosely wrapped around the product. Additional details regarding techniques for tailoring the position and dimensions of the opposing REE elements 402 to localize the emitted REE away from the heat-sensitive areas of the product are described infra.

With reference to FIGS. 4A-4D and FIGS. 5A-5B, during operation of the shrink tunnel system 100, the product (e.g., product 114, product 502 or the like) is loosely wrapped with the shrink film 116 and positioned on the conveyor belt 112 near the infeed opening 110. The shrink film 116 as wrapped around the product 502 can form a tube or sleeve around the product with the openings 514 on opposite sides thereof. The loosely wrapped product is then moved through the infeed opening 110 and into the heating oven 126 via the conveyor belt 112 in the machine direction. As the conveyor belt 112 moves the loosely wrapped product through the tunnel in the machine direction, the loosely wrapped product becomes positioned between the opposing REE elements 402 with the openings 514 in the shrink film 116 facing the respective emission surfaces 411 of the opposing REE elements 402.

When the loosely wrapped product is positioned between the opposing REE elements 402, the elements can apply REE to the shrink film 116 and the product (e.g., product 502, product 114 or the like). The REE applied to the shrink film 116 and product by the REE element gets absorbed by the shrink film 116, converted into heat and increases the temperature of the shrink film 116 around the product, causing the shrink film to shrink wrap around the product. As noted above, the angle or direction of the emitted REE is perpendicular to the machine direction and thus parallel or substantially parallel with the respective surfaces of the shrink film 116 as loosely wrapped around the product. As a result, the absorption of the REE by the film is maximized, thereby minimizing the amount of leftover energy applied to the product (e.g., the product container and its contents) and potential damage to the product caused by the REE. In addition, to the angle of emission, the dimensions (e.g., length and height) and position of the one or more REE elements 402 and can be tailored to prevent or minimize application of the REE to one or more heat-sensitive areas of the product, as discussed in greater detail below.

The duration of application of the REE and the amount of REE (e.g., intensity/temperature) applied can be tailored based on the REE absorbance level of the shrink film 116, the type of REE emitted (e.g., IR, RF, MW, UV, etc.), the activation temperature of the shrink film 116, the product type (e.g., plastic bottle, cardboard box, etc.), the material of the product 114, the softening temperature of the material, the contents of the product 114, the design of the product 114, and/or the dimensions of the product 114. The duration and amount (e.g., intensity/temperature) of REE applied can be controllable via one or more machine controls coupled to the respective REE elements 402 and optionally the control unit 120. In some implementations, one or more temperature sensors (e.g., thermocouples) can be coupled to the REE elements 402 to monitor the surface temperature of the respective elements which can be sent to the control unit for displaying to the operator and/or further processing as described with reference to FIG. 15. In some implementations, the duration and amount of REE applied can be controlled as function of the speed of the conveyor belt 112. For example, in some implementations, the conveyor belt 112 can be programmed and/or set to move the product through the tunnel (i.e., the heating oven 126) at a continuous speed. In other implementations, the conveyor belt 112 can be programmed and/or set to move the product through the tunnel at different speeds at different points within the tunnel and/or pause movement in at one or more specific points within the tunnel (e.g., when aligned and positioned between the REE elements 402 or another point). In some implementations, the length of the REE elements 402 can scale linearly with the speed of the conveyor belt 112.

The duration and amount of REE applied can also be tailored based on whether convective heat is also applied within the heating oven 126 in addition to the REE and the amount (e.g., temperature and duration) of heat applied. In this regard, the shrink tunnel system 100 can be configured to apply only REE radiant within the heating oven 126 and no heat (e.g., the heat may be turned off and/or the heating system may be excluded from the shrink tunnel system 100). In other embodiments, the shrink tunnel system 100 can be configured to apply both REE and heat (e.g., via the heating system) to the shrink film 116 and product (114 when located inside the heating oven 126 to shrink the film around the product. With these embodiments, the amount (e.g., temperature and/or duration) of hot air heat applied can be reduced relative to shrink wrapping systems that do not incorporate REE application. The combination of the REE heat with the reduced hot air temperature provides for significantly reducing damage and deformation to heat-sensitive areas of a product while further providing for robustly bundling the product according to the Bundle Rigidity Test (described herein).

The optimal amounts of convective heat and REE can be tailored to minimize the amount of convective heat and REE needed to achieve a robustly bundled/shrink wrapped product according to the Bundle Rigidity Test (described herein) without damage or deformation to the product. The optimal amounts (e.g., temperature/intensity and duration) of convective heat and REE can be tailored based the type of product type (e.g., plastic bottle, cardboard box, etc.), the material of the product 114, the softening temperature of the product 114, the activation temperature of the shrink film 116, the contents of the product 114, the design of the product 114, the dimensions of the product 114, the dimension of the group of products, the REE absorbance level of the shrink film 116, and the type of REE applied (e.g., IR, RF, MW, UV, etc.). For example, in some implementations in which both convective heat and IR heat is applied a group of loosely wrapped plastic cosmetic bottles with liquid contents (e.g., soap or another type of liquid or gel), the temperature of the heating system (e.g., the temperature within the heating oven 126) can be about 150° Celsius (C) to about 200° C. (and alternatively about 180° C.), and the temperature of the IR panels can be about 490° C. to about 510° C.

With these embodiments, the shrink tunnel system 100 can be adapted (e.g., configured and/or operatively controlled the control unit 120) to apply the convective heat and the REE at the same time, partially the same time (e.g., partially overlapping periods of time) and/or at separate non-overlapping periods of time. For example, in some implementations, the shrink tunnel system 100 can be configured to apply convective heat to the product and the shrink film 116 the entire duration of time the product is located inside the heating oven 126. In other implementations, the shrink tunnel system 100 can be configured to apply convective heat only a portion of the time. In this regard, the term "residence time" is used herein to refer to the duration of time the wrapped product is located inside the heating oven 126, the term "convective heat exposure time" or "exposure time" is used herein to refer to the duration of time the wrapped product is exposed to convective heat within the heating oven 126, and the term "REE application time" or "application time" is used herein to refer to the duration of time the wrapped product is exposed to REE within or outside the shrink tunnel. The convective heat exposure time and/or the REE application time can be less than or equal to the residence time. The REE application time may also be less than, greater than, or equal to the convective heat exposure time. The ratio of "REE application time" to "convective heat exposure time" can be from about 1:2 to about 1:1, alternatively from 1:1 to about 1:2, and alternatively from about 1:1 to about 1:5. The convective heat exposure time and the REE exposure time may occur at overlapping windows of time, non-overlapping windows of time, or partially overlapping windows of time.

Figure 4D:
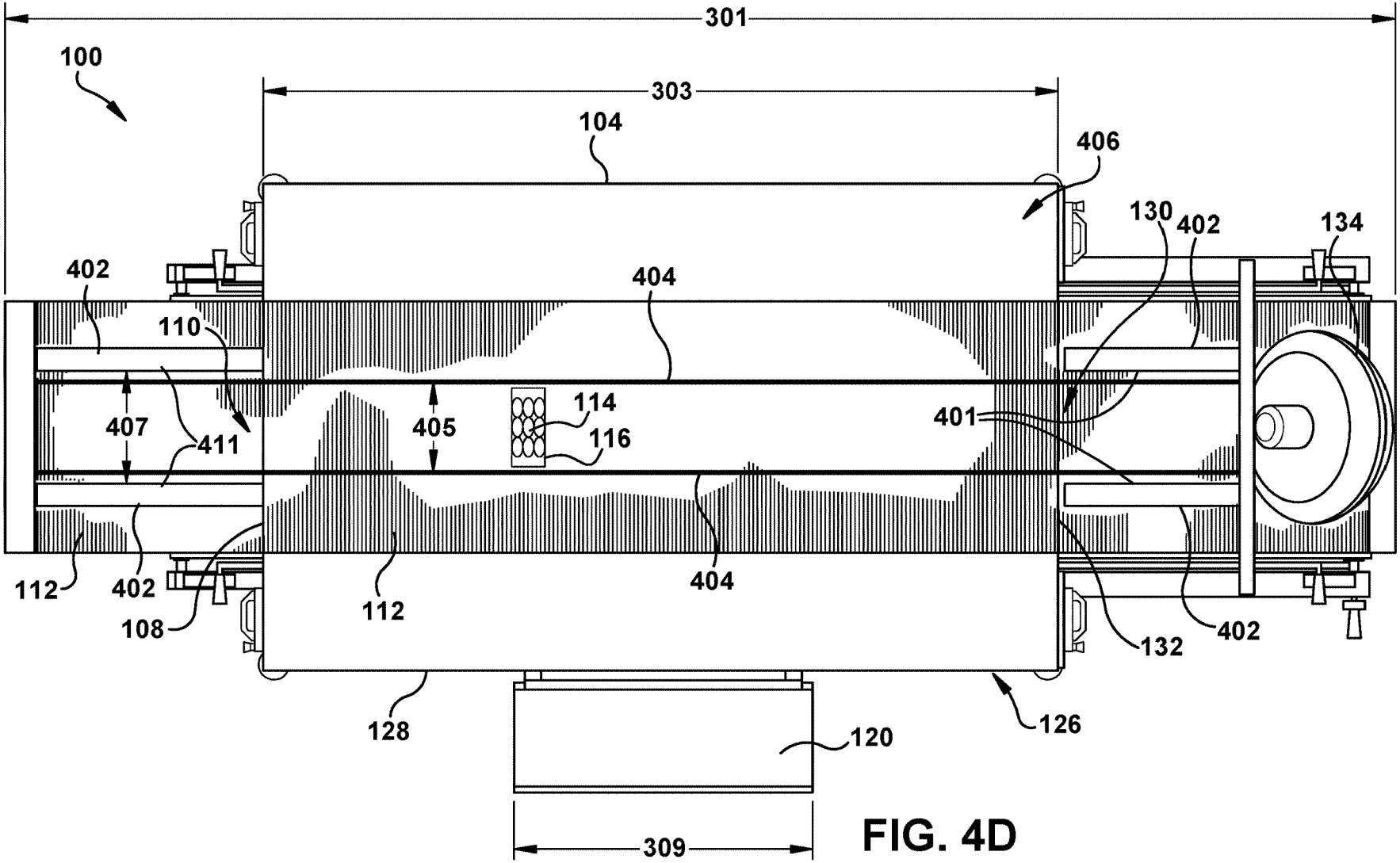

For example, as show in FIG. 4A, the opposing REE elements 402 are positioned within the front portion 401 of the heating oven 126 and excluded from the back portion 403 of the heating oven. With these implementations, the system can be adapted to apply convective heat when the loosely wrapped product is positioned in alignment with the REE elements 402 and/or after the product has moved through the front portion 401 and into the back portion 403. Various other convective heat and REE application configuration patterns are also envisioned. In this regard, the position of the one or more REE elements 402 along the length 301 of the conveyor belt 112, the dimensions of the elements, and number of the elements can vary and tailored for different usage contexts. FIG. 4A shows the opposing REE elements 402 can extend the entirety (or almost the entirety) of the front portion 401 and excluded from the back portion 403. The opposing REE elements 402 can abut or substantially abut the infeed opening 110 and/or be offset a defined distance from the infeed opening 110. FIG. 4B shows the opposing REE elements 402 can extend the entirety (or almost entirety) of the length 303 of the heating oven 126. FIG. 4C shows the opposing REE elements 402 can include a plurality of separate opposing elements can extend the length 303 of the heating oven 126. The distance 409 between the respective element can vary. With these embodiments, the individual elements and/or pairs of opposing elements (e.g., positioned on either side of the opposing guiderails 404 can be individually controlled (e.g., turned on/off and or intensity controlled), wherein the settings of these elements can be tailored to different usage contexts. In other embodiments, the opposing REE elements 402 can be positioned outside of the heating oven 126 on the conveyor belt 112 at or near the infeed opening 110 and/or the exit opening 130, as illustrated in FIG. 4D. With these embodiments, the length 301 of the conveyor belt 112 can be extended to accommodate the opposing REE elements 402 before and/or after the heating oven 126.

The distance 407 between the opposing REE elements 402 and the distance 405 between the opposing guiderails 404 can be tailored for different usage contexts. The distance 407 between the opposing REE elements 402 can be tailored to be closer or farther from the sides of the product or group of products (e.g., a group of bottles) to achieve the optimal intensity/temperature exposed to the product or group of products, which can be tailored as function of the type of product type (e.g., plastic bottle, cardboard box, etc.), the material of the product 114, the softening temperature of the product 114, the activation temperature of the shrink film 116, the contents of the product 114, the design of the product 114, the dimensions of the product 114, the dimension of the group of products, the electromagnetic energy absorbance level of the shrink film 116, the type of REE applied (e.g., IR, RF, MW, UV, etc.) and the amount (e.g., duration and temperature) of heat applied. In some implementations, the positions of the REE elements 402 and the opposing guiderails 404 can be adjustable either manually and/or electromechanically controlled to change the distances 405 and/or 407 respectively for different usage contexts.

Figure 6B:
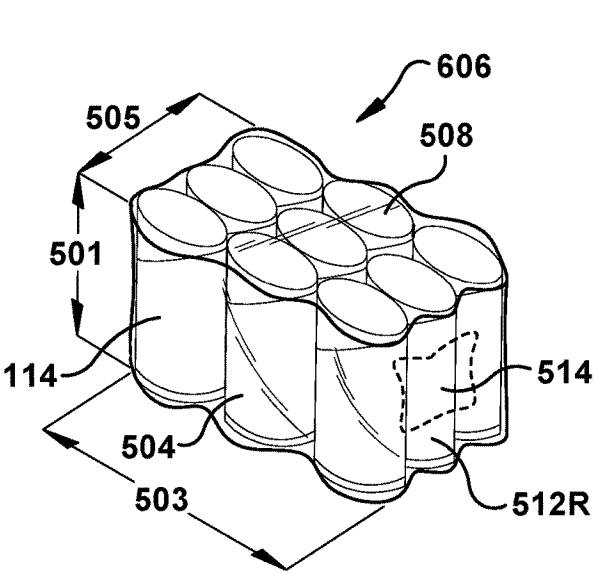
FIGS. 6A-6C illustrates an example product loosely wrapped with a shrink film and robustly bundled with the shrink film.
Figure 6A:
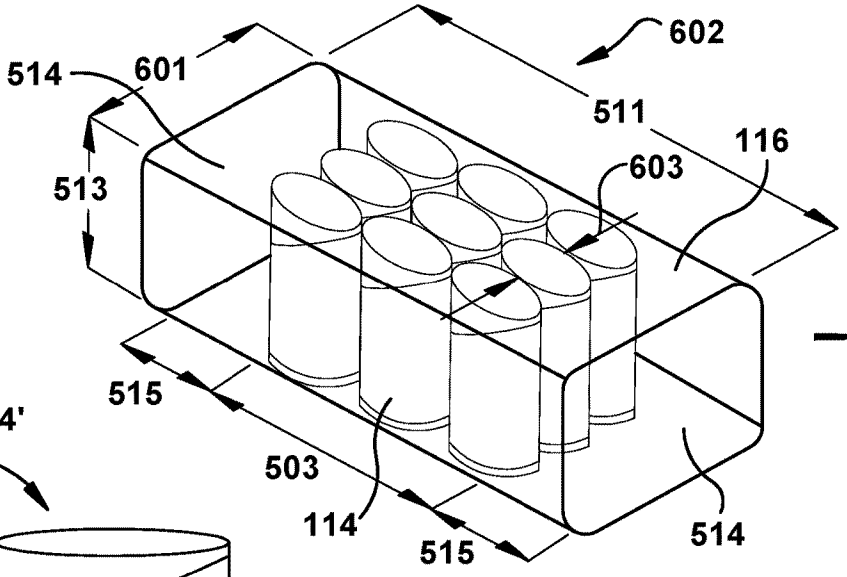

FIG. 6A illustrates an example product 114 loosely wrapped with a shrink film 116 (referred to as loosely wrapped product 602) and FIG. 6B illustrates the example product 114 robustly bundled with the shrink film 116 (referred to a robustly bundled product 606). The loosely wrapped product 602 corresponds to the product wrapped with the shrink film 116 before any REE and convective heat is applied during the shrink-wrapping process (e.g., before entry into the heating oven 126 in accordance with the configuration illustrated in FIGS. 4A-4C) and the robustly bundled product 606 corresponds to the product after REE and/or convective heat at is applied during the shrink-wrapping process (e.g., after exiting the heating oven 126 in accordance with the configuration illustrated in FIGS. 4A-4C). In this example, the product 114 comprises a group of heat-sensitive bottles, such as plastic cosmetic bottles or the like, however the type of product can vary. In various embodiments, the product 114 can correspond to product 502 illustrated in FIGS. 5A-5B (e.g., the plain box in FIGS. 5A-5B can be replaced with the group of bottles or another product). In this regard, with reference to FIGS. 5A-6C, as with product 502, the group of bottles can be defined by a top 508, a base 510 opposite the top (hidden from view), a front side 504, a back side 506 opposite the front side (e.g., hidden from view), a right side 512R and a left side 512L opposite the right side (e.g., hidden from view)). The product 114 can further be defined by height 501, width 503 and length 505. Similar to product 502 as illustrated in FIG. 5A, the loosely wrapped product 602 comprises the shrink film 116 wrapped around the front, back, top, and base surfaces of the product with the right and left sides of the product exposed by openings 514. FIGS. 7A-7C illustrates enlarged perspectives of an example loosely wrapped group of bottles 702 in accordance with one or more embodiments. In this example, the group of bottles includes six bottles. In various embodiments, the loosely wrapped group of bottles 702 can correspond to loosely wrapped product 602, noting the number and arrangement of the bottles can vary.

With reference to FIGS. 5A-7C, the loosely wrapped product 602 and the loosely wrapped group of bottles 702, the shrink film 116 as loosely wrapped around the group of bottles can also be defined by corresponding top, bottom front and back surfaces with openings 514 (e.g., indicated by the dashed lines) exposing the right and left sides of the group. The dimensions of the shrink film 116 as loosely wrapped around the product 114 can tailored to the dimensions of the product 114 (e.g., the dimensions of the group of the bottles) so as to cover the top, bottom, front and back surfaces of the group with the opposing right and left side surfaces 512L/R exposed. For example, the height 513 of the shrink film 116 can correspond to the height 501 of the product 114 and the length 601 of the shrink film 116 can correspond to the length 505 of the product 114. The width 511 of the shrink film 116 as loosely wrapped around the product 114 can extend the defined distance 515 beyond the width 503 of the product on opposite sides thereof. The defined distance 515 can be tailored for different product types and dimensions. After the shrink film reaches its activation temperature in response to absorption of the REE or the combination of REE and convention heat, these extended side portions of the shrink film 116 with the openings 514 shrink around the right side 512R and the left side 512L of the product to partially cover the right land left sides, as illustrated on the robustly bundled product 606.

Figure 6C:
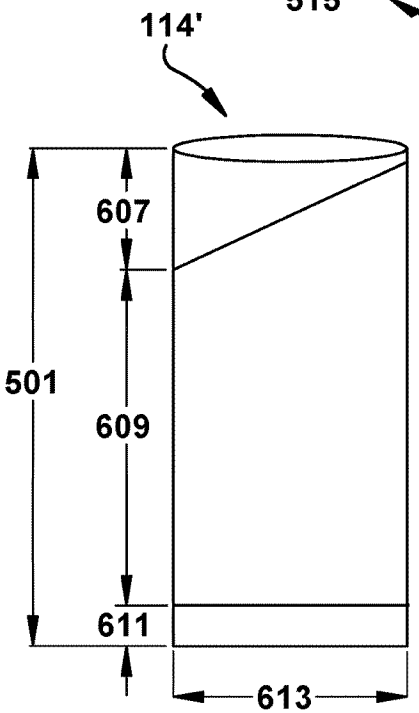
Figure 7B:
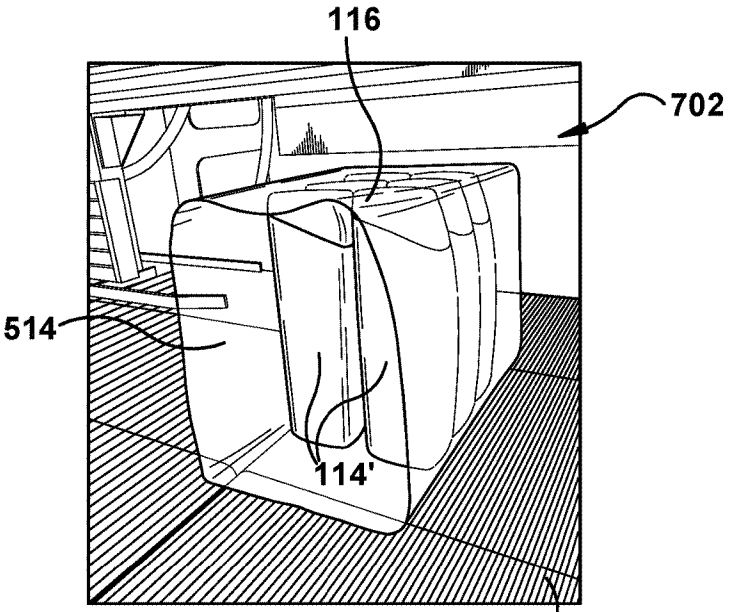
FIGS. 7A-7C illustrates enlarged perspectives of an example loosely wrapped bottle bundle in accordance with an embodiment.
Figure 7A:
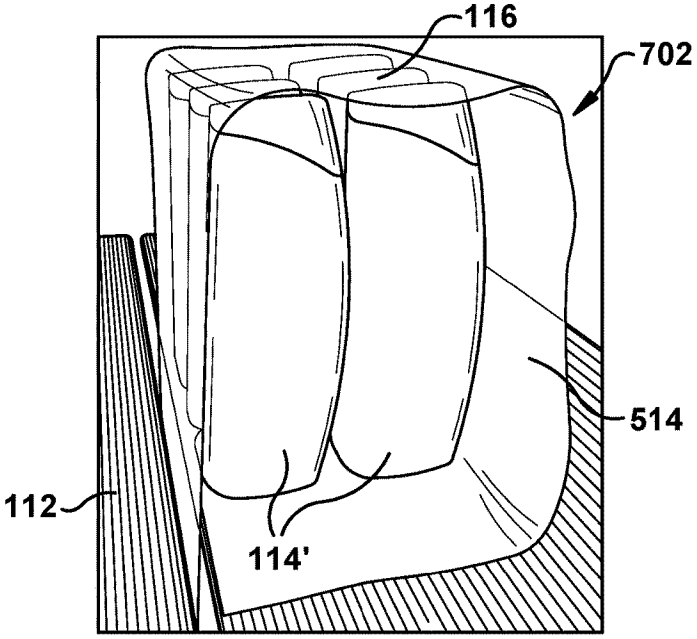
Figure 7C:
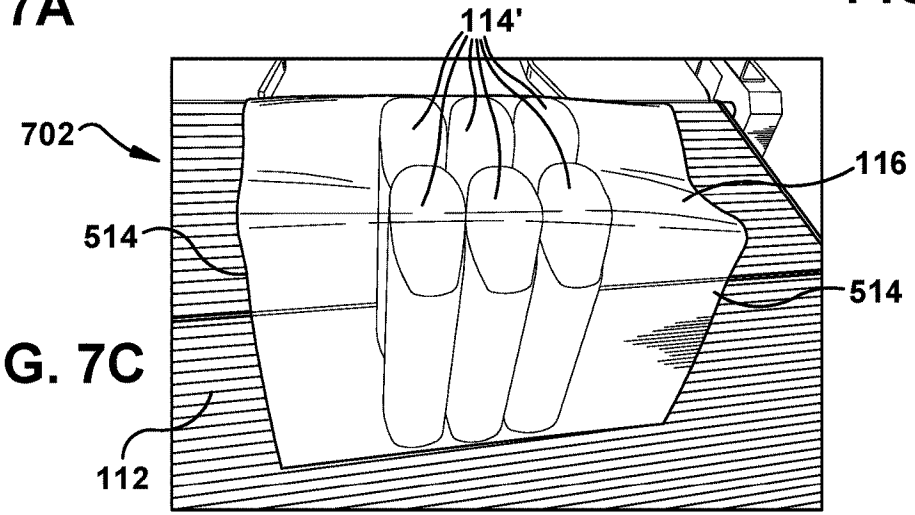

With reference to FIG. 6C, an enlarged view of a single bottle 114' included in the group is depicted below the loosely wrapped product 602. In various embodiments, the respective bottles can (and other types of products) are formed with a heat-sensitive material with a defined softening temperature, such as a polymeric material. The softening temperature can correspond to the minimum temperature at which the polymeric material begins to change its molecular structure and melt or deform. For example, the polymeric material can include, but is not limited to, polyethylene terephthalate (PET), high-density polyethylene (HDPE), low-density polyethylene (LDPE), polypropylene (PP), polyvinylchloride (PVC), polyethylene terephthalate glycol (PETG), polyethylene naphthalate (PEN), polystyrene (PS), and combinations thereof. The softening temperature of the material used to form the products can be less than or equal to 200° C., alternatively less than or equal to 190° C., alternatively less than or equal to 180° C., and alternatively less than or equal to 160° C. FIGS. 8A-8J illustrates some example bottle designs that can correspond to the respective bottles included in a group to be shrink-wrapped bundled in accordance with the disclosed techniques. As illustrated with reference to FIGS. 8A-8J, the design, shape and dimensions of the bottles can vary. Generally, each bottle can be defined by a bottom surface, a top surface opposite the bottom surface and a body extending from the top surface to the bottom surface adapted to contain a liquid. The shrink-wrapped bottles can be filled with a liquid product (e.g., soap, detergent, shampoo, conditioner, body wash, hand soap, mouthwash, surface cleaner, insect repellant) contained therein. In other examples, the shrink-wrapped bottles can be filled with a solid or a plurality of solids (e.g., laundry scent beads). The respective surfaces of each bottle can be defined by a wall formed with one or more of the above noted heat-sensitive materials. In some implementations, the wall thickness can be uniform across all portions of the bottle 114'. In other implementations, the wall thickness can vary for different parts of the bottle. The height 501 of the bottles can range between about 100 mm and about 300 mm, the length 613 can range between about 10.0 mm and about 150 mm, and the width 603 can range between about 10.0 mm and about 100 mm. In this regard, the dimensions of the group of bottles can vary based on the dimensions of the individual bottles and the manner in which they are arranged in the group (e.g., back-to-back, side-to-side, etc.). In one example, the group of bottes (i.e., product 114) can have height 501 of about 200 mm, a width 503 of about 250 mm, and a length 505 of about 100 mm.

Regardless of the shape and dimensions of the product 114 to be bundled (e.g., a group of bottles, a cardboard box, etc.), the product can include a heat-sensitive area and a heat-resistant region, wherein the heat-sensitive area is more susceptible to damage and deformation to applied heat relative to the heat-resistant region. For example, with respect to bottles formed with a polymeric material, when processed using conventional shrink-wrapping ovens without electromagnetic energy heat, the damage deformations typically include dimples and other distortions, usually observed at the upper shoulders and bottom corners of the bottles. The deformations are caused by softening the polymeric material of the bottles in the areas of heat concentration. FIG. 6C shows the heat-sensitive area of bottle 114' includes an upper heat-sensitive area 607 that corresponds to head or top of the bottle which typically includes the bottle lid or opening enclosure, and a lower heat-sensitive area 611 that corresponds to the base of the bottle. The heat-resistant region 609 generally includes the middle portion of the bottle that holds the majority of the bottle liquid content. This region is typically more resistant to heat deformations because the liquid content in this region serves as a heat sink. The dimensions of the heat-sensitive areas and the heat-resistant regions of the bottle 114' and other products however can vary depending on the product and the product design. The wall thickness of the heat-sensitive areas may be thinner than the wall thickness of the heat-resistant regions and/or made with a different material that has lower softening temperature than the heat-resistant regions.

The shrink film 116 can have a known REE absorbance level (e.g., IR absorbance level or the like) and a known activation temperature. The REE absorbance level corresponds to the percentage of the total REE energy absorbed by the shrink film which is converted by the shrink film 116 into heat. The activation temperature corresponds to the minimum temperature required to catalyze the shrink film to change its molecular structure from its elongated form to a condensed or recoiled form. The REE absorbance of the shrink film can be greater than or equal to 5%, alternatively greater than or equal to 15%, and alternatively greater than or equal to 30%. The activation temperature of the shrink film 116 can vary. The softening temperature of the heat-sensitive material used to form the product (e.g., each bottle 114' or the like) can be less than or equal to the activation temperature of the shrink film 116. The activation temperature of the shrink film can be less than or equal to 180° C., alternatively less than or equal to 150° C., and alternatively less than or equal to 140° C. The thickness of the shrink film 116 can vary and be tailored for different usage contexts and product types. The product 114 can comprise a group of heat-sensitive bottles and the thickness of the shrink film 116 can be selected based on wall/material thickness of the respective bottles. For example, the ratio of the wall thickness to the film thickness can less than or equal to 5:1, alternatively less than or equal to 4:1, alternatively less than or equal to 3:1, alternatively less than or equal to 2:1, and alternatively less than or equal to 1:1.

With reference to FIGS. 1-6C, as noted above, the REE emitted from the one or more REE elements 402 can be directed or localized to the heat-resistant regions (e.g., heat-resistant region 608) of the product 114 as opposed to the heat-sensitive areas of the product 114 (e.g., upper heat-sensitive area 607 and lower heat-sensitive area 611), thereby minimizing or preventing damage and deformations to the product while also forming a robustly bundled product 606. For example, the position the opposing REE elements 402 relative to the loosely wrapped product 602 as positioned on the conveyor belt 112 can be tailored to apply localized REE on the right side 512R and left side 512L of the product which are positioned a defined distance 521 away from the emission surfaces 411 of the opposing REE elements 402, wherein the defined distance minimizes the amount of REE absorbed by the product and maximizes the amount of REE absorbed by the shrink film 116 extending on opposite sides of the product. With this configuration, the REE emitted from the REE elements 402 reaches the side edges and overhanging portions of the shrink film 116 on the opposite sides of the product before the right and left side surfaces of the product, resulting in more absorption of the REE by the film relative to the product itself. The shrink film further converts the REE into heat which causes the shrink film to reach its activation temperature and shrink wrap around the product. When combined with convective heat, the amount of REE applied (e.g., intensity/temperature and duration) can be tailored to achieve the activation temperature of the shrink film 116 with a convective heat temperature that is lower than the softening temperature of the product. In this regard, the combination of REE heat and convective heat applied in the manner described can provide for lowering both the intensity of the REE heat and the convective heat while achieving the activation temperature of the film and minimizing product damage attributed to conventional shrink ovens that require higher temperatures to achieve the film activation temperature. This way, the shrink film 116 can be heated to its activation temperature without overheating the sensitive areas of the product.

The one or more REE elements 402 may also be positioned relative to the product and the shrink film 116 such the angle/direction of the REE applied is parallel to the plane or surface of the film, thereby maximizing the amount of REE absorbed by the film relative to the amount absorbed by the product, as described above. Additionally, or alternatively, the dimensions and position of the REE elements 402 can be tailored based on the relative dimensions and positions of the heat-resistant and heat-sensitive areas of the product such that the REE energy is directed away from the heat-sensitive areas of the product. For example, in one implementation in which the product comprise a group of bottles respectively corresponding to bottle 114', the height 509 of the REE elements can be less than or equal to the length of the heat-resistant region 609, and the REE elements can be positioned over the conveyor belt 112 such that the height 509 extends in the longitudinal direction between the upper heat-sensitive area and the lower heat-sensitive area 611. Other suitable ways of focusing the REE toward the heat-resistant region and away from the heat-sensitive area of the product include, but are not limited to using REE elements 402 (e.g., IR panels) with a concave shaped surface that faces the product, using mirrors around the REE elements 402 to direct the REE energy toward the heat-resistant region 609 and away from the heat-sensitive areas 607 and 611, using lenses between the REE elements and the product to direct the REE toward the heat-resistant region 609 and away from the heat-sensitive areas 607 and 611, and using several smaller panels localized against the heat-resistant areas of the product as opposed to a single larger panel.

Figure 9:
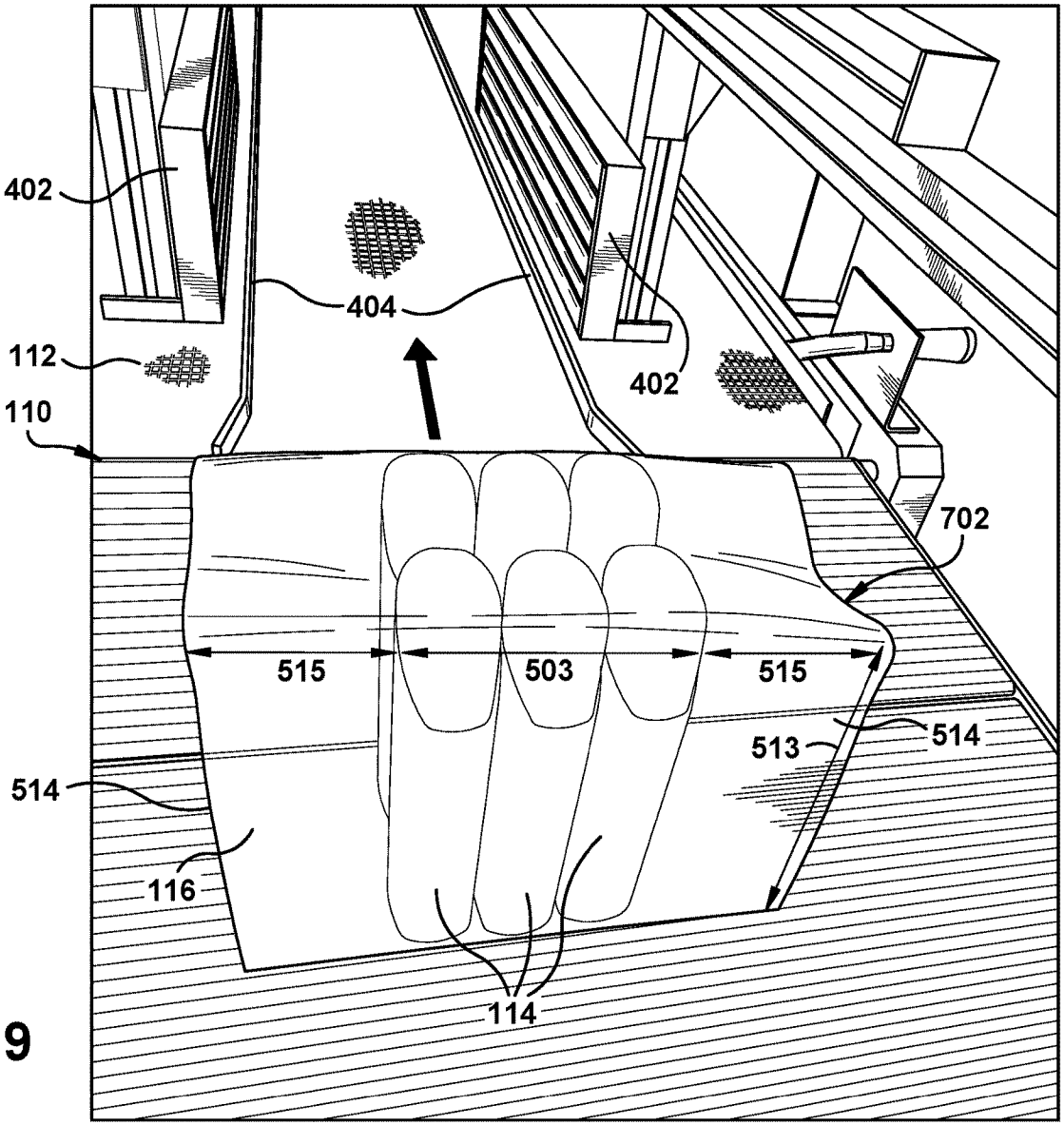
FIG. 9 illustrates the inside of the heating oven from the entry opening in accordance with an embodiment.

FIG. 9 illustrates a portion of the inside of the heating oven 126 from the perspective of the infeed opening 110 with the loosely wrapped product 802 positioned on conveyor belt 112. As illustrated in FIG. 9, during operation the loosely wrapped product 802 can be positioned on the conveyor belt 112 aligned between the opposing guiderails 404 with base or bottom surface contacting the conveyor belt 112 and the openings 514 on the sides facing outward along axis X-X' shown in FIGS. 1 and 4A. With this configuration the, when the loosely wrapped product 802 is advanced forward into the heating oven in the machine direction (e.g., indicated by the white arrow), the openings 514 and right and left side surfaces of the product will face the opposing REE elements 402.

Figure 10:
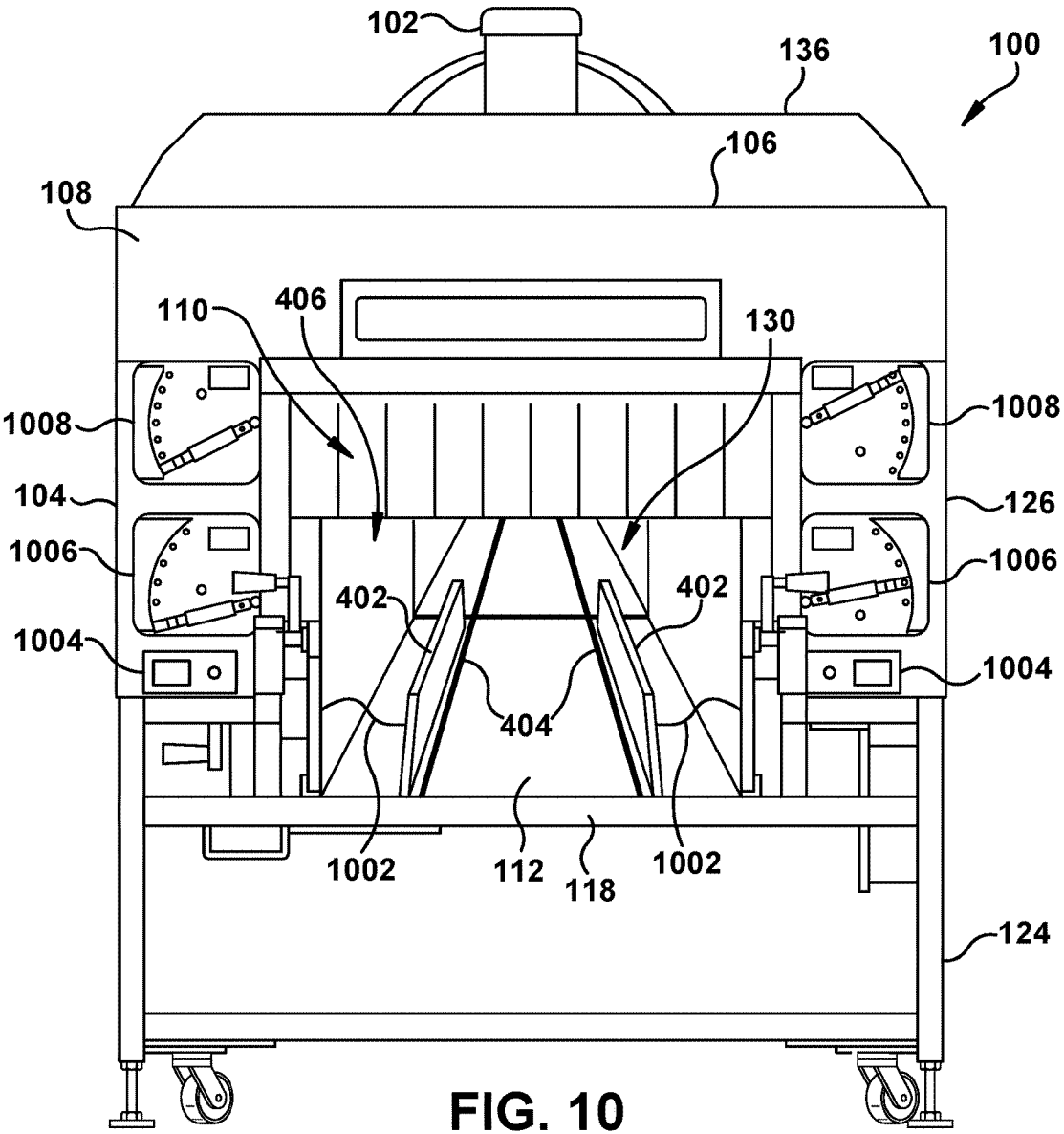
FIG. 10 presents an entry-side perspective of an example shrink tunnel system for shrink wrap bundling a heat-sensitive product in accordance with one or more embodiments.

FIG. 10 presents another entry-side perspective of an example shrink tunnel system 100 for shrink wrap bundling a heat-sensitive product in accordance with one or more embodiments. FIG. 10 introduces some additional components of the shrink tunnel system. In the embodiment shown, the front side 108 of the shrink tunnel system 100 can include power controllers 904 for each of the opposing REE elements 402 that provide for controlling the power of the elements, wherein the power level controls the intensity of the amount of REE emitted (and the subsequent amount of heat generated therefrom). The opposing REE elements 402 can be electrically and/or operatively coupled to their respective power controllers 1004 via one or more wires 902. In other embodiments, the power controllers 1004 can be incorporated into the control unit 120. The front side 108 of the shrink tunnel system 100 further includes lower damper controls 1006 and upper damper controls 1008 on the right and left sides of the machine. The respective damper controls can control corresponding dampers of the heating system to direct radiant hot air to specific areas of the heating oven. In other embodiments, the damper controllers can be incorporated into the control unit 120.

Figure 11:
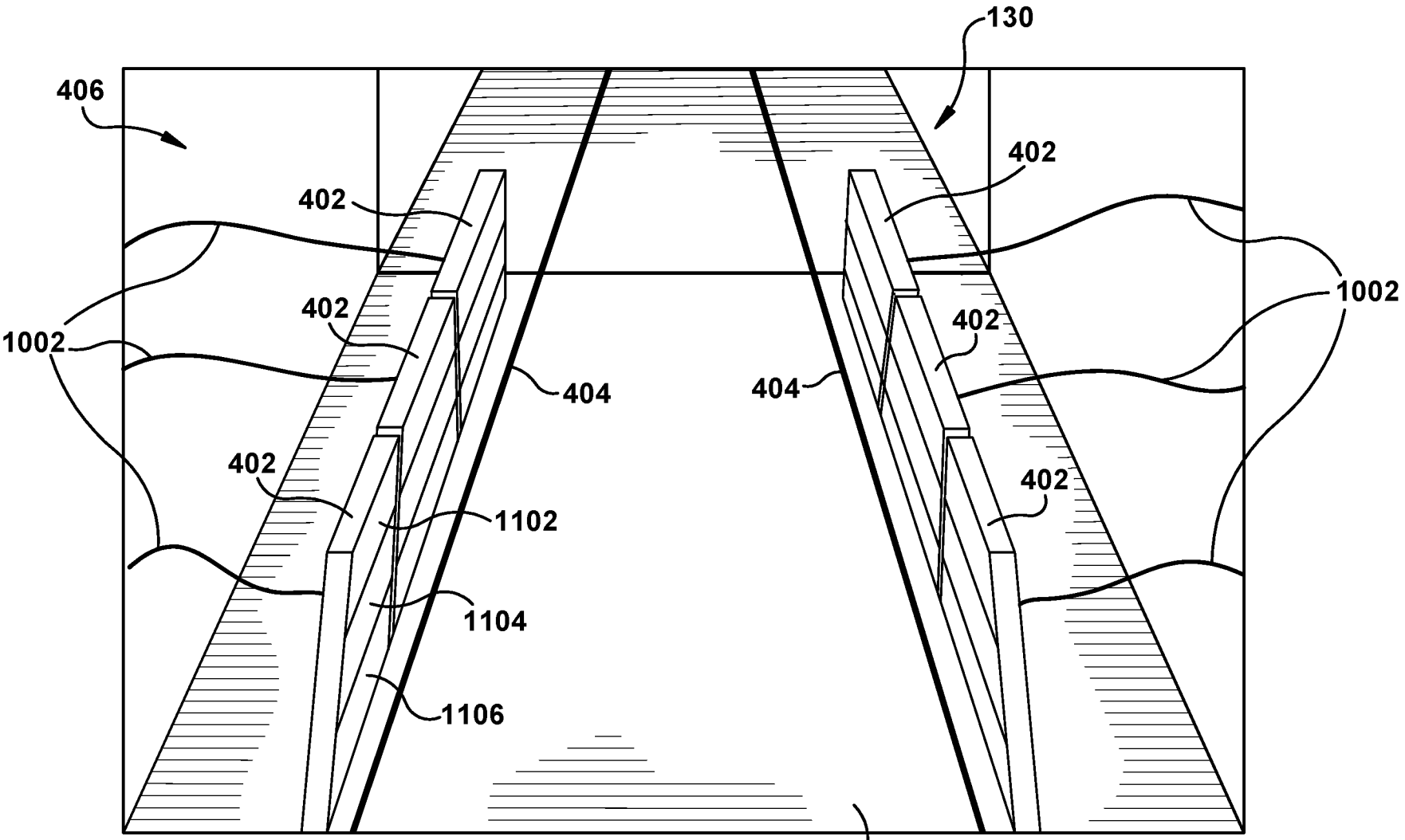
FIG. 11 presents an enlarged view of the inside of the heating oven from the entry-view perspective in accordance with another embodiment.

FIG. 11 presents an enlarged view of the inside 406 of the heating oven from the entry-view perspective in accordance with the embodiments illustrated in FIG. 4C. In accordance with this embodiment, each of the individual REE elements 402 can be separately controlled for different usage contexts (e.g., separately turned on/off as needed and/or intensity power adjusted). In some implementations, the opposing REE elements 402 can include separate zones located in different positions vertically (e.g., zone 1102, zone 1104 and zone 1106) that can also be separately controlled for different usage contexts (e.g., separately turned on/off as needed and/or intensity power adjusted. For example, the different zones can be separately turned on/off and/or controlled to different power levels based on the relative positions of the heat-sensitive and heat-resistant regions of the product so as to direct the radiation toward the heat-resistant region of the product and away from the heat-sensitive area.

Figure 12:
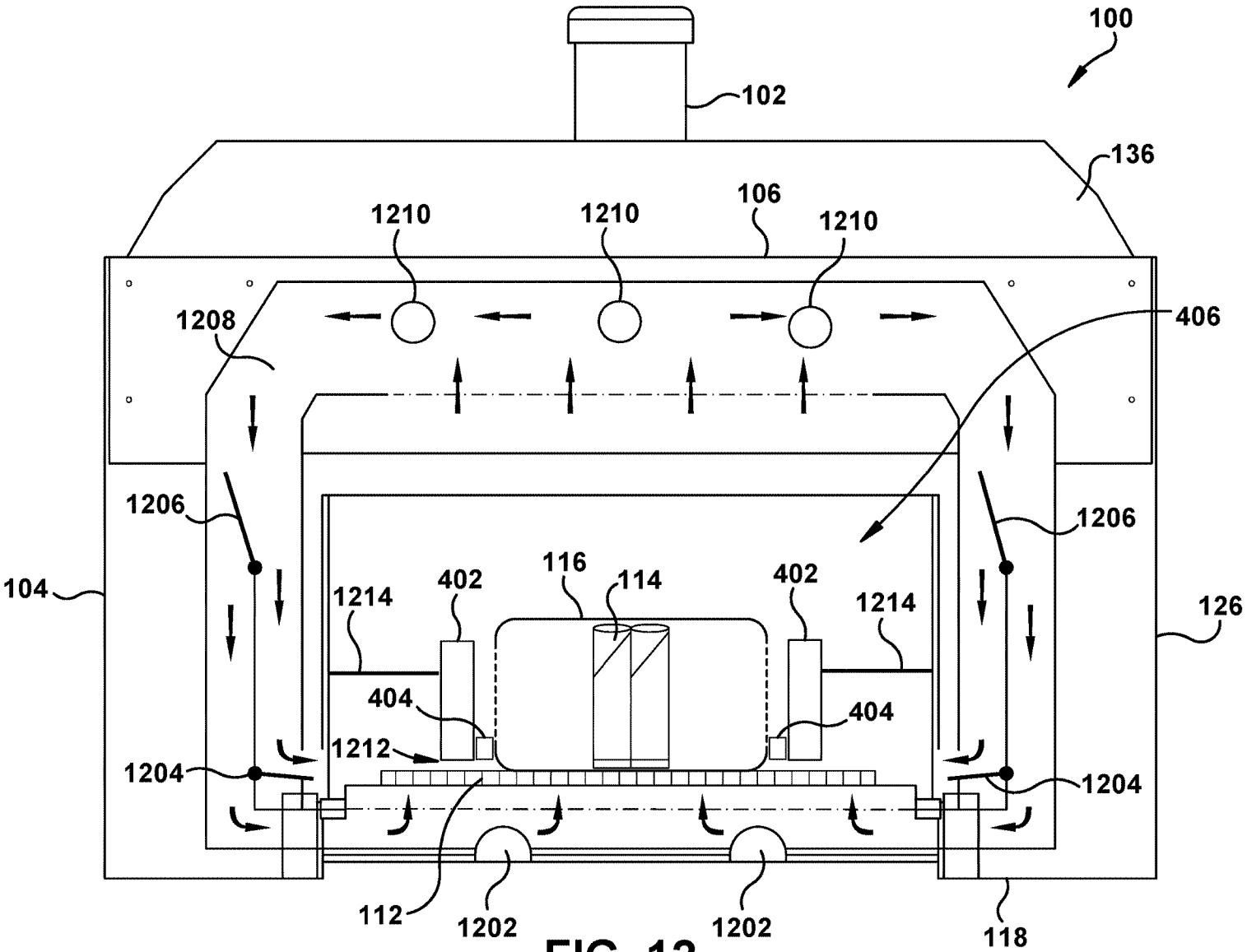
FIG. 12 illustrates a cross-sectional view of an example shrink tunnel system in accordance with an embodiment.

FIG. 12 illustrates a cross-sectional view of an example shrink tunnel system 100 taken along axis X-X' shown in FIG. 1, in accordance with one or more embodiments. FIG. 12 illustrates aspects of the heating system of the shrink tunnel system 100. The heating system can include one or more heating elements 1210 and fans (not shown) located at or near the top of the chamber, wherein the fans are coupled to one or more fan motors located within the ventilation area 102. The heating system can further include upper dampers 1206, lower dampers 1204 and bottom dampers 1202 with adjustable slotted plates. The fans draw the air across the heating elements and direct the heated air down the sides of the tunnel through one or more ducts 1208 to discharge hot radiant air into the heating oven 126. The respective dampers are adjustable and direct the hot air to specific areas of the heating oven. FIG. 12 also illustrates the relative position of the bottom surfaces of the REE elements 402 and the opposing guiderails 404 to the top surface of the conveyor belt 112. As illustrated, the REE elements 402 and the opposing guiderails 404 can be mounted over the conveyor belt via respective mounts 1214 such that a gap 1212 is provided between the bottom surfaces of the REE elements 402 and the opposing guiderails 404, thereby allowing the conveyor belt 112 to move underneath in the machine direction.

Figure 13:
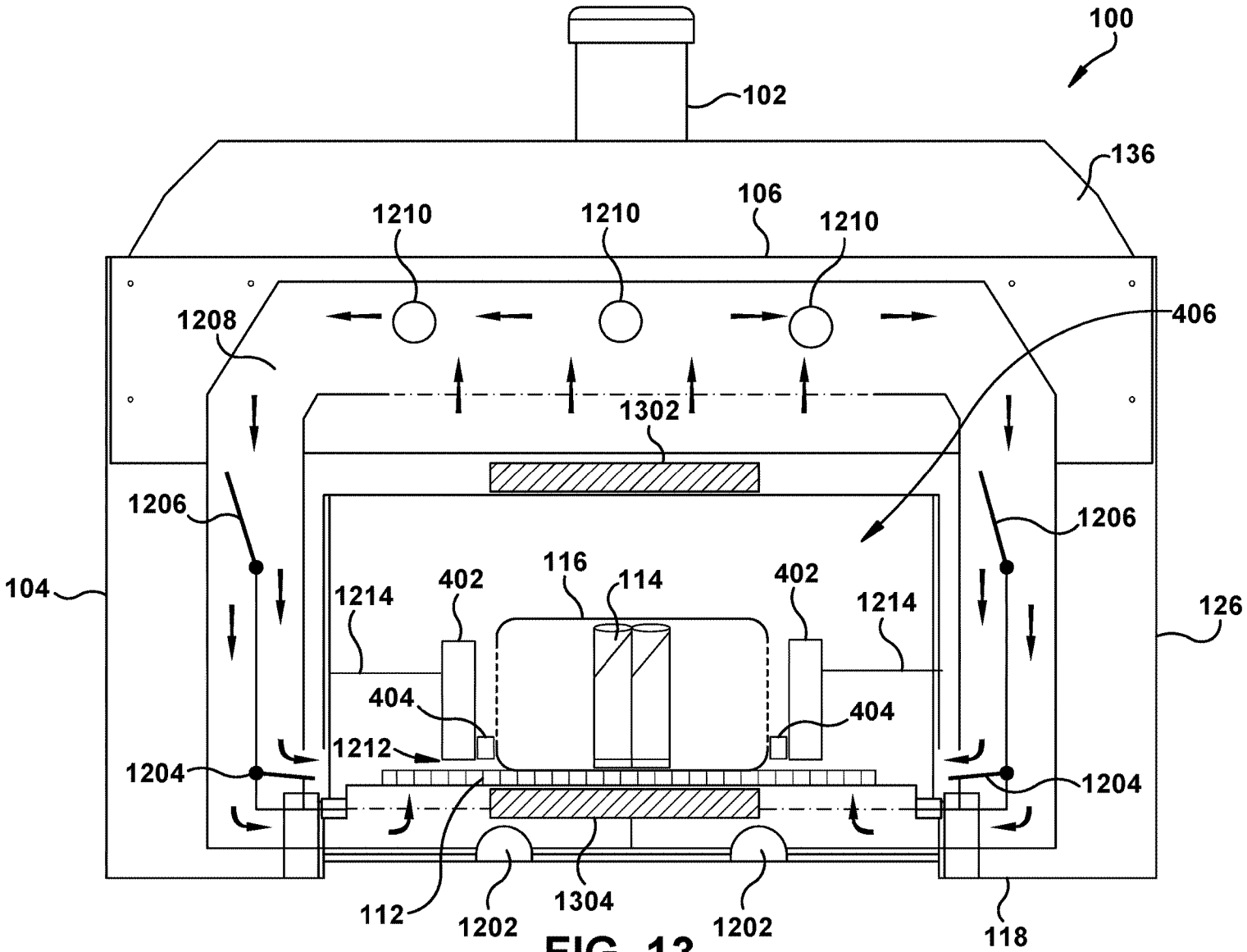
FIG. 13 illustrates a cross-sectional view of an example shrink tunnel system in accordance with another embodiment.

FIG. 13 illustrates a cross-sectional view of an example shrink tunnel system 100 taken along axis X-X' shown in FIG. 1. FIG. 13 shows one or more additional heating elements that can be included at or near the top of the heating oven (e.g., upper heating element 1302) and/or the bottom of the heating oven under the conveyor belt 112 (e.g., lower heating element 1304) to assist with shrink-wrapping the shrink film on the top and bottom surfaces of the product 114 (e.g., a group/bundle of bottles or the like). The upper heating element 1302 and/or the lower heating element 1304 can correspond to REE elements 402 (e.g., IR panels, RF panels, MW panels, UV panels, or the like) and/or convective heat elements. The lower heating element 1304 can heat the the lower/bottom surface of the shrink film 116 contacting the surface of the conveyor belt 112 and base of the product 114 directly by the energy penetrating toward the lower/bottom surface of the shrink film 116 and base of the product 114 through the conveyor belt 112 (e.g., which can be formed with a metal wire mesh through which the emitted energy/heat is emitted). Additionally, or alternatively, the lower heating element 1304 can only directly heat the conveyor belt 112 which then indirectly heats the lower/bottom surface of the shrink film 116 contacting the surface of the conveyor belt 112 and base of the product 114 (e.g., the lower heating element 1304 heats the conveyor belt 112, thereby heating the bundled product from below). In some embodiments, the lower heating element 1304 can heat the conveyor belt 112 before the product is placed thereon and delivered to the inside 406 of the heating oven 126. Still in other embodiments, the sources of REE are combined with a heating medium different from convective heat, such as steam or nitrogen.

Figure 14:
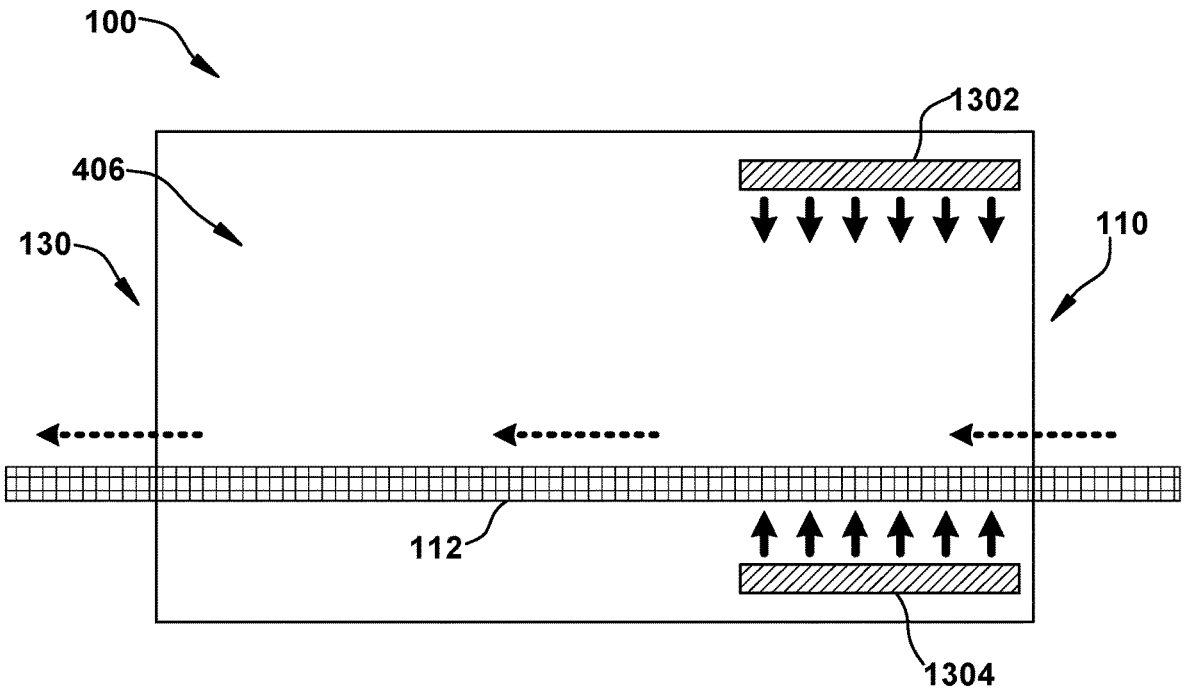
FIG. 14 illustrates a side view perspective of an example shrink tunnel system in accordance with another embodiment.

FIG. 14 illustrates a side view perspective of an example shrink tunnel system 100 in accordance with the embodiment illustrated in FIG. 13 including the lower heating element 1304 and the upper heating element 1302. Several elements of the shrink tunnel system 100 depicted in FIG. 13 have been removed from this side view perspective for ease of illustration (e.g., the opposing REE elements 402, the product 114 as loosely wrapped with shrink film 116, etc.). The lower heating element 1304 and the upper heating element 1302 can be placed near the infeed opening 110 of the shrink tunnel system as shown in FIG. 14 and/or other positions along the length of the conveyor belt 112 and emit energy/heat in a direction perpendicular or substantially perpendicular to the surface of the conveyor belt 112.

Figure 15:
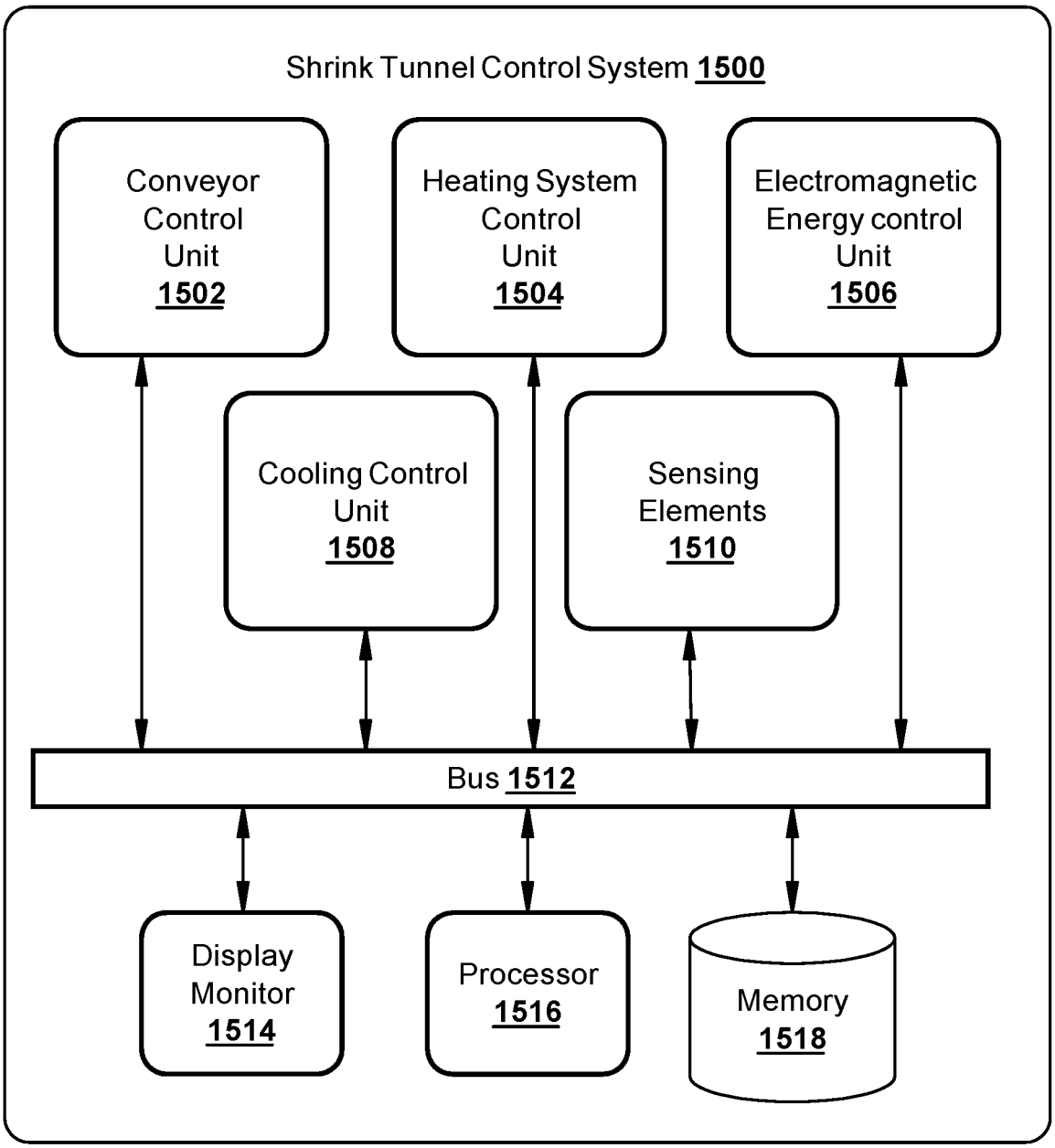
FIG. 15 illustrates a block diagram of an example, non-limiting shrink tunnel control system in accordance with one or more embodiments.
Figure 16:
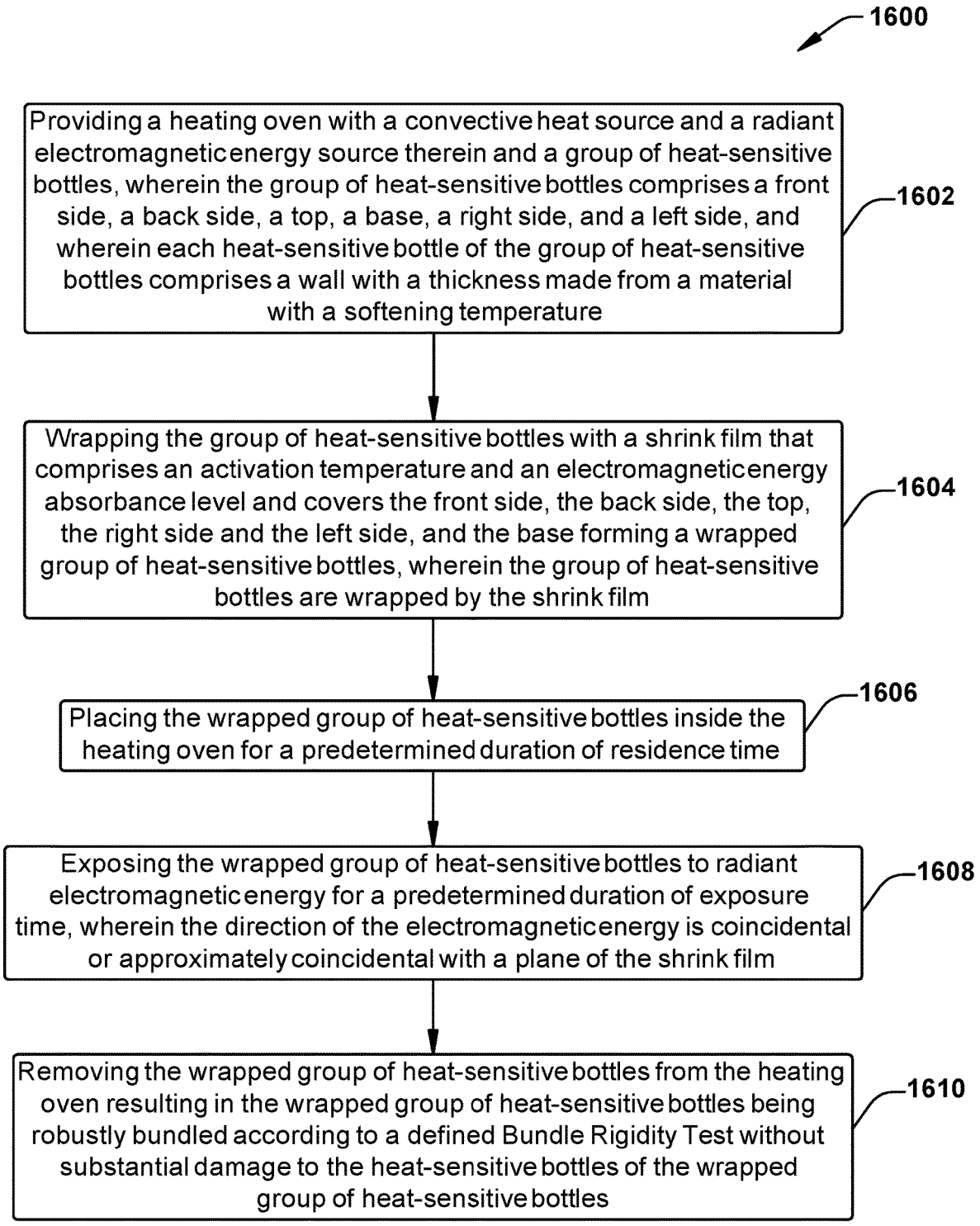
FIG. 16 illustrates a high-level flow diagram of an example method for shrink wrap bundling a heat-sensitive product in accordance with one or more embodiments.

FIG. 15 illustrates a block diagram of an example, non-limiting shrink tunnel control system 1500 in accordance with one or more embodiment. With reference to FIGS. 1 and 15, the shrink tunnel control system 1500 can be include on or within the control unit 120 and/or a remove computing device communicatively and/or operatively coupled to the control unit 120 via one or more wired or wireless connections. The shrink tunnel control system 1500 can include a display monitor 1514 (which can correspond to display 122), processor 146, and memory 1418 and one or more sensing elements 1510 (e.g., temperatures sensors, thermocouples, REE sensors, power sensors, etc.). The memory 1518 can store computer executable components, and the processor 1516 can executes the computer executable components stored in the memory 1518. The system bus 1512 can communicatively and operatively couple the respective components to one another and/or their associated electromechanical components of the shrink tunnel system 100. These computer executable components can include including conveyor control unit 1502 for controlling operations of the conveyor belt 112 (e.g., speed), heating system control unit 1504 for controlling operations of the heating system, electromagnetic energy control unit 1506 for controlling operations of the REE elements 402, and cooling control unit 1408 for controlling operations of the fan 134 or other cooling elements FIG. 16 illustrates a high-level flow diagram of an example method 1600 for shrink wrap bundling a heat-sensitive product that can be performed using the shrink tunnel system 100 in accordance with one or more embodiments. At 1602, method 1600 comprises providing a heating oven with a convective heat source and a radiant electromagnetic energy source therein and a group of heat-sensitive bottles, wherein the group of heat-sensitive bottles comprises a front side, a back side, a top, a base, a right side, and a left side, and wherein each heat-sensitive bottle of the group of heat-sensitive bottles comprises a wall with a thickness made from a material with a softening temperature. At 1604, method 1600 comprises wrapping the group of heat-sensitive bottles with a shrink film that comprises an activation temperature and an electromagnetic energy absorbance level and covers the front side, the back side, the top, the right side and the left side, and the base forming a wrapped group of heat-sensitive bottles, wherein the group of heat-sensitive bottles are wrapped by the shrink film. At 1606, method 1600 comprise placing the wrapped group of heat-sensitive bottles inside the heating oven for a predetermined duration of residence time. At 1608, method 1600 further comprises exposing the wrapped group of heat-sensitive bottles to radiant electromagnetic energy for a predetermined duration of exposure time, wherein the direction of the electromagnetic energy is coincidental or approximately coincidental with a plane of the shrink film. At 1610, method 1600 further comprises removing the wrapped group of heat-sensitive bottles from the heating oven resulting in the wrapped group of heat-sensitive bottles being robustly bundled according to a defined Bundle Rigidity Test without substantial damage to the heat-sensitive bottles of the wrapped group of heat-sensitive bottles.

In accordance with method 1600, the optimal amounts of convective heat and REE can be tailored to minimize the amount of convective heat and REE needed to achieve a robustly bundled/shrink wrapped group of bottles according to the Bundle Rigidity Test (described below) without damage or deformation to the product. The optimal amounts (e.g., temperature/intensity and duration) of convective heat and REE can be tailored based the type of product type (e.g., plastic bottle, cardboard box, etc.), the material of the product 114, the softening temperature of the product 114, the activation temperature of the shrink film 116, the contents of the product 114, the design of the product 114, the dimensions of the product 114, the dimension of the group of products, the REE absorbance level of the shrink film 116, and the type of REE applied (e.g., IR, RF, MW, UV, etc.).

Examples

Figures 8A, 8B, 8C, 8D, 8E:
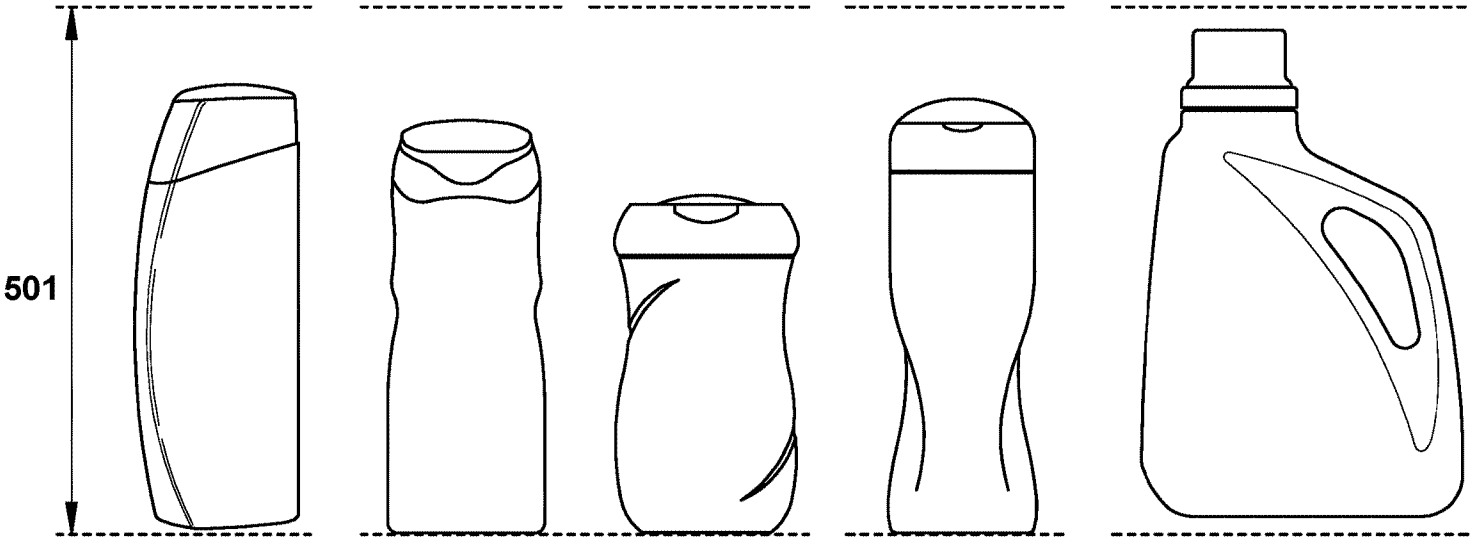
FIGS. 8A-8J illustrate example bottle designs that can be robustly group bundled using the disclosed infrared assisted bundling techniques.
Figures 8F, 8G, 8H, 8I, 8J:
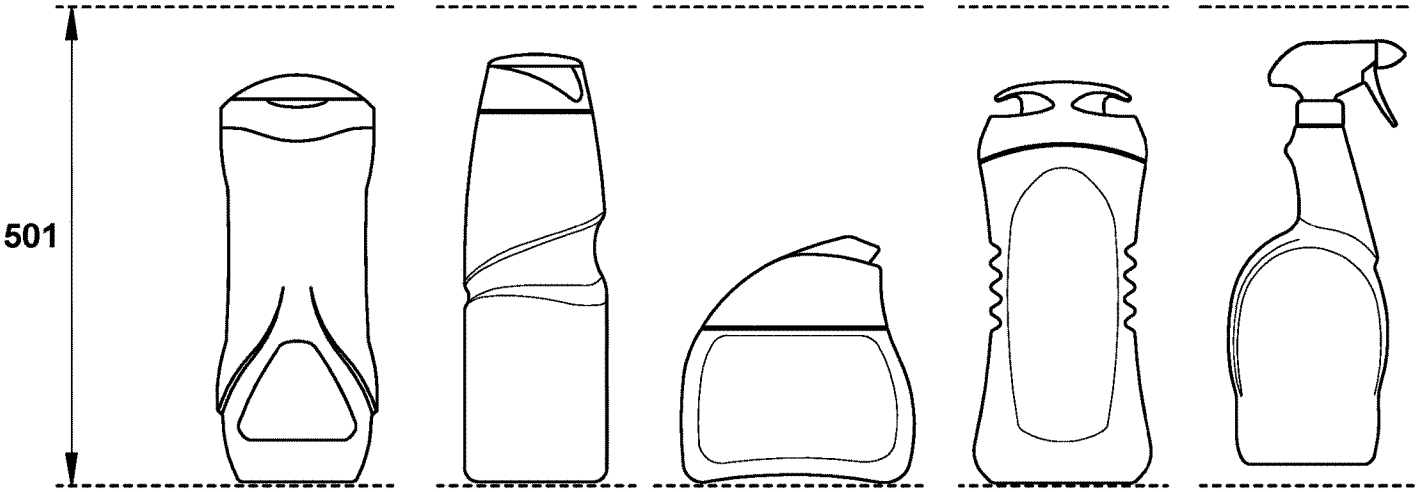

The following tests were performed in association with bundling groups of six lightweight, heat sensitive PET bottles and a standard low cost shrink film with an integrated absorbance level of 11.43% with the peak wavelength of 3.8 microns. The following bottles were tested:

Type 1 corresponds to the bottle shown in FIG. 8A with a 400 ml size

Type 2 corresponds to the bottle shown in FIG. 8B with a 400 ml size

The test was performed at the conditions outlined in the tables below with a CERMEX oven with two IR heaters installed to the inside of the oven. The heaters were installed at the infeed of the tunnel and at 1 inch height from the stainless-steel carrier belt. The CERMEX was run at 30 ft/min (9.14 m/min). The distribution of the hot air in the oven was controlled by the adjustable duct plates called dampers. The dampers were able to change the volume ratio of the air supplied to the bundle's sides and bottom. The position of the damper is described by the A %/B % ratio, where A % is the percent of air directed to the sides, and B % is the percent of air directed to the bottom. A %+B % equals 100%.

The bundle quality was considered strong if it satisfied the Bundle Rigidity Test, described hereafter.

The bottom quality was strong if the film was flat and overlapping portions of the film were secure and bonded together. The bottle quality was not strong if the film formed waves, flaps, was crumpled or otherwise sticks out from the plane of the flat bottom.

Damage was determined by visual detection. If by visual detection the bottle did not have any noticeable damage including, but not limited to, dimpling and/or other forms of deterioration, then it was determined that the bottle was not damaged. On the other hand, if by visual detection the bottle appeared to have visible damage, it was damaged. As used herein, "visual detection" means that a human viewer can visually discern the quality of the bottle with the unaided eye (excepting standard corrective lenses adapted to compensate for near-sightedness, farsightedness, or stigmatism, or other corrected vision) in lighting at least equal to the illumination of a standard 100-watt incandescent white light bulb at a distance of 30 cm.

To be acceptable, the system needed to provide strong bundles and strong bottoms without damaging the bundles for both Type 1 and Type 2 bottles. It is important that the conditions work for more than one shape and/or size to limit changeover time when switching bottle shapes and/or sizes on the packaging line.

Test #1

The first test was to determine whether there was an oven temperature that could create a strong bundle without damaging the bottle. We increased the oven temperature setting in 10° F. increments from 300 to 340° F., changed the settings of the side/bottom dampers and used IR, but were unable to find a proper baseline setting. As we found later, the cause of this was the robust HE bottles which remained intact throughout our test on that day.

TABLE 1

| Oven Temp (° F.) | Dampers % side/% bottom | Dampers % Total | IR (° C.) | Bundle Quality | Bottom Quality | Bottle Type | Damage |
|---|---|---|---|---|---|---|---|
| 300 | 40/60 | 100 | OFF | weak | weak | 2 | NO |
| 300 | 40/60 | 100 | 490 | weak | weak | 2 | NO |
| 310 | 40/60 | 100 | 490 | weak | weak | 2 | NO |
| 320 | 40/60 | 100 | 490 | strong | weak | 2 | NO |
| 320 | 20/80 | 100 | 490 | weak | weak | 2 | NO |
| 330 | 60/40 | 100 | 490 | strong | weak | 2 | NO |
| 340 | 40/60 | 100 | 490 | strong | weak | 2 | NO |
| 340 | 60/40 | 100 | 490 | strong | weak | 2 | NO |

As shown in Table 1, the oven temperatures all prevented the bottles from being damaged. However, many of the bundles were weak and all the bottoms were weak. Therefore, an oven temperature of 300-340° F. (148.9-171.1° C.) was not sufficient.

Test #2

For the second test, the oven temperature was constant (set at 350° F.), which was higher than Test #1. The settings for both the side/bottom and total flow dampers were changed.

TABLE 2

| Oven Set (° F.) | Dampers % side/% bottom | Dampers % Total | IR (° C.) | Bundle quality | Bottom quality | Bottle | Damage |
|---|---|---|---|---|---|---|---|
| 350 | 40/60 | 60 | OFF | strong | strong | 2 | NO |
| 350 | 40/60 | 40 | OFF | strong | strong | 2 | NO |
| 350 | 40/60 | 20 | OFF | weak | weak | 2 | NO |
| 350 | 20/80 | 100 | OFF | strong | strong | 2 | NO |
| 350 | 0/100 | 100 | OFF | weak | strong | 2 | NO |
| 350 | 0/100 | 100 | ON | weak | strong | 2 | NO |

As shown in Table 2, the Type 2 bottle was not damaged at 350° F. (182.2° C.) and thus appeared robust. Some of the conditions tested were also able to create strong bundles and strong bottles and would be acceptable for shipping and transporting bundles of bottles. Other bottle shapes needed to be tested to determine what conditions could work over more than one bottle shape.

Test 3

Additional testing was performed to determine which conditions would work for Type 1 and Type 2 bottles.

TABLE 3

| Ex. | Oven Set (° F.) | Dampers % side/% bottom | Dampers % Total | IR | Bundle quality | Bottom quality | Bottle | Damage |
|---|---|---|---|---|---|---|---|---|
| A | 360 | 0/100 | 100 | OFF | medium | strong | 2 | NO |
| B | 360 | 0/100 | 100 | ON | better | strong | 2 | NO |
| C | 360 | 0/100 | 100 | ON, higher than Ex. B | strong | strong | 2 | NO |
| D | 360 | 0/100 | 100 | ON, higher than Ex. C | strong | strong | 1 | YES |
| E | 340 | 40/60 | 100 | OFF | strong | strong | 2 | NO |
| F | 330 | 40/60 | 100 | OFF | strong | strong | 2 | NO |
| G | 320 | 40/60 | 100 | OFF | weak | weak | 2 | NO |
| H | 320 | 40/60 | 100 | ON | strong | weak | 1 | YES |

TABLE 3-continued

| Ex. | Oven Set (° F.) | Dampers % side/% bottom | Dampers % Total | IR | Bundle quality | Bottom quality | Bottle | Damage |
|---|---|---|---|---|---|---|---|---|
| I | 320 | 40/60 | 100 | ON, lower than Ex. H | strong | weak | 1 | YES |
| J | 310 | 40/60 | 100 | OFF | weak | weak | 1 | YES |

As shown in Table 3, Bottle Type 1 was less robust and more easily damaged than Bottle Type 2. For example, at 360° F. (182.2° C.) there is no damage to Bottle Type 2, however, at this same temperature Bottle Type 1 was damaged. More testing was needed to determine the conditions for the Type 1 bottle.

Test 4

TABLE 4

| Oven Set (° F.) | Dampers % side/% bottom | Dampers % Total | IR (° C.) | Bundle quality | Bottom quality | Bottle | Damage |
|---|---|---|---|---|---|---|---|
| 300 | 40/60 | 100 | OFF | weak | weak | 1 | NO |
| 300 | 40/60 | 100 | 465 | weak | weak | 2 | NO |
| 360 | 0/100 | 100 | OFF | strong | strong | 1 | YES |
| 350 | 0/100 | 100 | OFF | weak | weak | 1 | NO |
| 355 | 0/100 | 100 | OFF | medium | medium | 1 | NO |
| 355 | 0/100 | 100 | 505 | strong | strong | 1 | NO |
| 355 | 0/100 | 100 | 510 | strong | strong | 1 | NO |

As shown in Table 4, it was found that setting the oven to 360° F. (182° C.) was too high and caused deformation with the Type 1 bottle. When the temperature was dropped to 350° F. (176.7° C.), the damage disappeared but the bundle became weak. Then the oven temperature was increased to 355° F. (179.4° C.) and the bundle was weak, but still without the bottle damage. Thus, we determined that 355° F. (179.4° C.) is the highest temperature for maintaining bottle integrity.

When the IR was added, it was found that the side/bottom dampers need to be set at 0/100 (i.e., 100% of the air is applied to the bottom) setting to maximize the quality of the bundle bottom. It was found that these process settings produced 10 good quality bundles without making process adjustments.

Test Method

Bundle Rigidity Test

Bundle rigidity is tested by displacing a half of the bundle called "displaced half" relative to the other (static) half of the bundle, by a certain distance at a certain displacement rate and measuring the force required to achieve this. A suitable bundle for the test contains six bottles in a 3×2 configuration. Each half comprises three bottles. To pass the test, the force required to move the displaced half by a predetermined distance must be higher than a specified threshold. The test apparatus consists of the stationary platform, a top clamp, and a pusher. The bundle is tested in its vertical orientation. The static half of the bundle is clamped between the platform and the top clamp. The bottom of the displaced half is not supported. A pusher comes on top of the displaced half in a vertical motion and keeps moving downwards until the desired displacement is achieved, at which point the pusher stops and retreats. The data acquisition system records the pushing force and the displacement of the pusher. As used herein, a bundle of a group of heat-sensitive products is "robustly bundled" if the bundle requires more than 150 N force to move the displaced the half of the bundle by 10.0 mm at a rate of 150 mm/min Combinations:

A. A method for bundling a group of heat-sensitive products, comprising:

providing a heating oven with a convective heat source and a radiant electromagnetic energy source therein and a group of heat-sensitive products, wherein the group of heat-sensitive products comprises a front side, a back side, a top, a base, a right side, and a left side, and wherein each heat-sensitive product of the group of heat-sensitive products comprises a wall with a thickness made from a material with a softening temperature;

wrapping the group of heat-sensitive products with a shrink film that comprises an activation temperature and an electromagnetic energy absorbance level and covers the front side, the back side, the top, the right side and the left side, and the base forming a wrapped group of heat-sensitive products, wherein the group of heat-sensitive products are wrapped by the shrink film;

placing the wrapped group of heat-sensitive products inside the heating oven for a predetermined duration of residence time;

exposing the wrapped group of heat-sensitive products to radiant electromagnetic energy for a predetermined duration of exposure time, wherein the direction of the electromagnetic energy is coincidental or approximately coincidental with a plane of the shrink film; and removing the wrapped group of heat-sensitive products from the heating oven resulting in the wrapped group of heat-sensitive products being robustly bundled according to a defined Bundle Rigidity Test without substantial damage to the heat-sensitive products of the wrapped group of heat-sensitive products.

B. The method according to Paragraph A, wherein the softening temperature of the material is less than or equal to the activation temperature of the shrink film.

C. The method according to any of Paragraphs A-B, wherein the electromagnetic energy is localized to an area outside of heat-sensitive areas of the group of heat-sensitive products, wherein the heat-sensitive areas comprise first areas of the heat-sensitive products that are more easily distorted or otherwise damaged or generate more undesirable effects than the rest of the product.

D. The method according to Paragraph C, wherein the localization of the area outside of the heat-sensitive areas comprises tailoring dimensions and a position of the radiant electromagnetic energy source based on relative dimensions and positions of a heat-sensitive area and a heat-resistant region resistant of the group of heat-resistant products as placed within the heating oven.

E. The method according to any of Paragraphs A-D, wherein the shrink film further comprises a thickness and a ratio of the thickness of the wall to a thickness of the shrink film is equal to or less than at least one of 5:1, 4:1, 2:1 or 1:1.

F. The method according to any of Paragraphs A-D, wherein the shrink film further comprises a thickness and a ratio of the thickness of the wall to a thickness of the shrink film is equal to or less than 3:1.

G. The method according to any of Paragraphs A-F, wherein the heat-sensitive products comprise a polymeric material selected from polyethylene terephthalate, polyethylene naphthalate, polyethylene, polypropylene, polystyrene, and combinations thereof.

H. The method according to Paragraph G, wherein the polymeric material comprises polyethylene terephthalate.

I. The method according to any of Paragraphs A-H, wherein the predetermined duration of exposure time is less than or equal to the residence time.

J. The method according to any of Paragraphs A-I, wherein a ratio of the exposure time to the residence time is from about 1:20 to about 1:1, preferably from 1:10 to about 1:2, and most preferably from about 1:10 to about 1:5.

K. The method according to any of Paragraphs A-J, wherein the electromagnetic energy absorbance level of the shrink film is greater than or equal to 5%, preferably greater than or equal to 15%, or more preferably greater than or equal to 30%.

L. The method according to any of Paragraphs A-K, wherein the activation temperature of the shrink film is reached with a lower convective heat temperature relative to the heating oven without the radiant electromagnetic energy source.

M. A system, comprising:

a heating oven adapted to:

provide convective heat and radiant electromagnetic energy;

receive a group of heat-sensitive products, wherein the group of heat-sensitive products has a front side, back side, top, base, right side and left side, wherein each heat-sensitive product of the group of heat-sensitive products comprises a wall with a thickness made from a material with a softening temperature, and wherein the group of heat-sensitive products are wrapped with a shrink film that comprises an activation temperature and electromagnetic energy absorbance level and covers the front side, back side, base, and back side of the group of heat-sensitive products forming a wrapped group of heat-sensitive products;

expose the wrapped group of heat-sensitive products to radiant electromagnetic energy for a predetermined duration of exposure time, wherein the direction of the electromagnetic energy is coincidental or approximately coincidental with a plane of the shrink film; and generate a wrapped group of heat-sensitive products robustly bundled according to a defined Bundle Rigidity Test without substantial damage to the heat-sensitive products of the wrapped group of heat-sensitive products;

one or more heating elements coupled to the heating and that provide the convective heat inside the heating oven; and a radiant electromagnetic energy source that emits the radiant electromagnetic energy inside the heating oven, wherein dimensions of the radiant electromagnetic energy source and a position of the radiant electromagnetic energy source within the heating oven result in localizing the radiant electromagnetic energy to a heat-resistant region of the heat-sensitive products as opposed to localizing the radiant electromagnetic energy to the heat-sensitive area of the heat-sensitive products when the heat-sensitive product is located inside the heating oven.

N. The system according to Paragraph M, wherein the radiant electromagnetic energy source emits the electromagnetic energy in a direction parallel to respective surfaces of the shrink film as loosely wrapped around the group of heat-sensitive products when the group of heat-sensitive products is located inside the heating oven.

O. The system according to any of Paragraphs M-N, wherein the heating oven comprises a ceiling, a base opposite the ceiling, opposing sidewalls, an infeed opening and an exit opening, and wherein the system further comprises:

a conveyor belt adjacent to the base that feeds the product into the heating oven in a machine direction through the infeed opening and out of the heating oven through the exit opening, wherein the radiant electromagnetic energy source comprises opposing infrared radiation panels located over the conveyor belt and separated by a defined distance; and opposing guide rails positioned over the conveyor belt between the opposing infrared radiation panels along the machine direction that prevent the shrink film from contacting the opposing infrared radiation panels.

P. The system according to any of Paragraphs M-O, wherein each heat-sensitive product of the group of heat-sensitive products is defined by a base region, a head region and a body extending in the longitudinal direction between the base region and the head region, wherein the radiant electromagnetic energy source further comprises a lower infrared radiation panel positioned under the conveyor belt that heats the conveyor belt and indirectly heats a base surface of the shrink film located adjacent to the base region.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for bundling a group of heat-sensitive products, comprising:

providing a heating oven with a convective heat source and a radiant electromagnetic energy source therein and the group of heat-sensitive products, wherein the group of heat-sensitive products comprises a front side, a back side, a top, a base, a right side, and a left side, and wherein each heat-sensitive product of the group of heat-sensitive products comprises a wall with a thickness;

wrapping the group of heat-sensitive products with a shrink film that comprises an activation temperature and an electromagnetic energy absorbance level forming a wrapped group of heat-sensitive products;

placing the wrapped group of heat-sensitive products inside the heating oven for a predetermined duration of residence time;

exposing the wrapped group of heat-sensitive products to radiant electromagnetic energy for a predetermined duration of exposure time; wherein the electromagnetic energy is localized to an area outside of heat-sensitive areas of the group of heat-sensitive products, wherein the heat-sensitive areas comprise first areas of the heat-sensitive products that are more easily distorted or otherwise damaged or generate more undesirable effects than the rest of the product; and removing the wrapped group of heat-sensitive products from the heating oven resulting in the wrapped group of heat-sensitive products wherein the wrapped group of heat-sensitive products is robustly bundled according to the Bundle Rigidity Test, described herein, without substantial damage to the heat-sensitive products of the wrapped group of heat-sensitive products.

2. The method of claim 1, wherein the shrink film is made from a material with a softening temperature and the softening temperature is less than or equal to the activation temperature of the shrink film.

3. The method of claim 1, wherein the direction of the electromagnetic energy is coincidental or approximately coincidental with a plane of the shrink film.

4. The method of claim 1, wherein the shrink film covers the front side, the back side, the top, the right side and the left side, and the base forming the wrapped group of heat-sensitive products.

5. The method of claim 1, wherein the heat-sensitive products comprise a polymeric material selected from polyethylene terephthalate, polyethylene naphthalate, polyethylene, polypropylene, polystyrene, and combinations thereof.

6. The method of claim 5, wherein the polymeric material comprises polyethylene terephthalate.

7. The method of claim 1, wherein the predetermined duration of exposure time is less than or equal to the residence time.

8. The method of claim 1, wherein a ratio of the exposure time to the residence time is from about 1:20 to about 1:1.

9. The method of claim 1, wherein the electromagnetic energy absorbance level of the shrink film is greater than or equal to 5%.

10. The method of claim 1, wherein the activation temperature of the shrink film is reached with a lower convective heat temperature relative to the temperature without the radiant electromagnetic energy source.

11. A system, comprising:

a heating oven adapted to:

provide convective heat and radiant electromagnetic energy;

receive a group of heat-sensitive products, wherein the group of heat-sensitive products has a front side, back side, top, base, right side and left side, and wherein the group of heat-sensitive products are wrapped with a shrink film that comprises an activation temperature and electromagnetic energy absorbance;

expose the wrapped group of heat-sensitive products to radiant electromagnetic energy for a predetermined duration of exposure time, wherein the electromagnetic energy is localized to an area outside of heat-sensitive areas of the group of heat-sensitive products, wherein the heat-sensitive areas comprise first areas of the heat-sensitive products that are more easily distorted or otherwise damaged or generate more undesirable effects than the rest of the product; and a radiant electromagnetic energy source that emits the radiant electromagnetic energy inside the heating oven, wherein dimensions of the radiant electromagnetic energy source and a position of the radiant electromagnetic energy source within the heating oven result in localizing the radiant electromagnetic energy to a heat-resistant region of the heat-sensitive products as opposed to localizing the radiant electromagnetic energy to the heat-sensitive area of the heat-sensitive products when the heat-sensitive product is located inside the heating oven wherein the wrapped group of heat-sensitive products is robustly bundled according to the Bundle Rigidity Test, described herein, without substantial damage to the heat-sensitive products of the wrapped group of heat-sensitive products.

12. The system of claim 11, wherein the radiant electromagnetic energy source emits the radiant electromagnetic energy in a direction parallel or substantially parallel to respective surfaces of the shrink film as loosely wrapped around the group of the heat-sensitive products when the group of heat-sensitive products are located inside the heating oven.

13. The system of claim 11, wherein the heating oven comprises a ceiling, a base opposite the ceiling, opposing sidewalls, an infeed opening and an exit opening, and wherein the system further comprises:

a conveyor belt adjacent to the base that feeds the wrapped group of heat-sensitive products into the heating oven in a machine direction through the infeed opening and out of the heating oven through the exit opening, wherein the radiant electromagnetic energy source comprises opposing infrared radiation panels located over the conveyor belt and separated by a defined distance.

14. The system of claim 13, wherein each of the heat-sensitive products of the group of heat-sensitive products is defined by a base region, a head region and a body extending in longitudinal direction between the base region and the head region, wherein the heat-resistant region corresponds to the body and the heat-sensitive area corresponds to the base region and the head region, wherein the opposing infrared radiation panels have a height less than or equal to height of the body, and wherein the height of opposing radiation panels extends between the base region and the head region.

15. The system of claim 13, wherein the opposing sidewalls comprise a left sidewall and a right sidewall, and wherein the opposing infrared radiation panels comprise two or more left side panels positioned side by side along a length of the left sidewall in the machine direction, and two or more right side panels positioned side by side along a length of the right sidewall in the machine direction.

16. The system of claim 11, wherein each heat-sensitive product of the group of heat-sensitive products is defined by a base region, a head region and a body extending in longitudinal direction between the base region and the head region, wherein the heat-resistant region corresponds to the body and the heat-sensitive area corresponds to the base region and the head region, wherein the radiant electromagnetic energy source comprises opposing infrared radiation panels positioned opposite the right side and the left side of the group of heat-sensitive products as placed within the heating oven, wherein the opposing infrared radiation panels have a height less than or equal to height of the body, and wherein the localizing comprises positioning the height of opposing radiation panels between the base region and the head region.

17. The system of claim 11, wherein each heat-sensitive product of the group of heat-sensitive products is defined by a base region, a head region and a body extending in longitudinal direction between the base region and the head region, wherein the radiant electromagnetic energy source further comprises a lower infrared radiation panel positioned under the conveyor belt.

18. The system of claim 11, wherein the direction of the electromagnetic energy is coincidental or approximately coincidental with a plane of the shrink film.

* * * * *